US006166590A

United States Patent [19]

Friedman et al.

[11] Patent Number: 6,166,590

[45] Date of Patent: Dec. 26, 2000

[54] CURRENT MIRROR AND/OR DIVIDER CIRCUITS WITH DYNAMIC CURRENT CONTROL WHICH ARE USEFUL IN APPLICATIONS FOR PROVIDING SERIES OF REFERENCE CURRENTS, SUBTRACTION, SUMMATION AND COMPARISON

[75] Inventors: Eby Friedman; Radu M. Secareanu, both of Rochester, N.Y.

[73] Assignee: The University of Rochester, Rochester, N.Y.

[21] Appl. No.: 09/312,744

[22] Filed: May 14, 1999

Related U.S. Application Data

[60] Provisional application No. 60/086,325, May 21, 1998.

[51] Int. Cl.[7] ..... G05F 1/10

[52] U.S. Cl. ..... 327/543; 327/538; 323/314; 323/316

[58] Field of Search ..... 327/538, 543, 327/545, 546; 330/288; 323/312, 313, 314, 316

[56] References Cited

U.S. PATENT DOCUMENTS

| | | | |
|---|---|---|---|
| 4,360,866 | 11/1982 | Main et al. | 327/104 |
| 4,431,986 | 2/1984 | Haque et al. | 340/347 |
| 4,638,184 | 1/1987 | Kimura | 323/311 |
| 4,825,099 | 4/1989 | Barton | 323/315 |
| 4,933,648 | 6/1990 | Frogge | 330/288 |
| 4,973,857 | 11/1990 | Hughes | 323/315 |
| 5,045,773 | 9/1991 | Westwick et al. | 323/316 |
| 5,475,336 | 12/1995 | Singh et al. | 327/543 |
| 5,481,179 | 1/1996 | Keeth | 327/543 |
| 5,512,816 | 4/1996 | Lambert | 323/315 |
| 5,594,382 | 1/1997 | Kato et al. | 327/543 |
| 5,612,614 | 3/1997 | Barrett, Jr. et al. | 323/316 |
| 5,625,281 | 4/1997 | Lambert | 323/315 |
| 5,680,037 | 10/1997 | Carobolante | 323/315 |
| 5,686,824 | 11/1997 | Rapp | 323/313 |
| 5,757,226 | 5/1998 | Yamada et al. | 327/541 |
| 5,805,005 | 9/1998 | Raisinghani et al. | 327/333 |
| 6,002,245 | 12/1999 | Sauer | 327/539 |

OTHER PUBLICATIONS

A.B. Grebene, "Bipolar and MOS Analog Integrated Circuit Design", John Wiley & Sons, Inc., 1984, pp. 169–277, 299–303, 771–823.

Toumazou et al., "Analogue IC Design: the current–mode approach", Peter Peregrinus Ltd., London 1990, pp. 238–343, 491–513.

Itakura et al. "High Output–Resistance CMOS Current Mirrors for Low Voltage Applications", IEICE Transactions of Fundamentals, Communications And Computer Sciences, vol. E80–A, No. 1, pp. 203–232, Jan. 1997.

Wasaki et al., "Current Multiplier/Divider Circuit", Electronics Letters, vol. 27, No. 6, pp. 504–506, Mar. 1991.

(List continued on next page.)

*Primary Examiner*—Timothy P. Callahan
*Assistant Examiner*—An T. Luu
*Attorney, Agent, or Firm*—Kenneth J. Lukacher; Martin Lukacher

[57] ABSTRACT

Circuit useful as current mirror and/or current divider has a circuit topology containing mirror and reference transistor pairs, respectively provided by MOS P and N type transistors for the up and down mirrors. The mirror transistor in each pair is followed by a buffer transistor which provides the current output. The topology obtains equal input and output currents through the DC biasing of the reference and mirror transistors by providing equality of the D to S and G to S voltages operative in both the reference and mirror transistors of both mirrors. The topology provides matched performance for the up and down current mirrors with very high mirroring accuracy, design insensitive up and down mirrored current, excellent operation over a wide power supply range, temperature insensitive precision, and the possibility of conveniently obtaining a wide range of current divisions. This topology is appropriate for those applications in which precise current handling and division is necessary such as high accuracy A/D and D/A converters, reference cells, current subtractors, and high precision current comparators.

20 Claims, 20 Drawing Sheets

OTHER PUBLICATIONS

Zeki et al. "Accurate and high output impedance current mirror suitable for CMOS current output stages", Electronics Letters, vol. 33, No. 12, pp. 1042–1043, Jun. 1997.

Mulder et al. "High–swing cascode MOS current mirror", Electronics Letters, vol. 32, No. 14, pp. 1251–1252, Jul. 1996.

Akiya et al. "High–precision MOS current mirror", IEE Proceedings I, vol. 131, No. 5, pp. 170–175, Oct. 1984.

Serrano et al. "The Active–Input Regulated–Cascode Current Mirror", IEEE Transactions on Circuits and Systems I:Fundamental Theory and Applications, vol. CAS I–41, No. 6, pp. 464–467, Jun. 1994.

Sackinger et al. "A High–Swing, High–Impedence MOS Cascode Circuit", IEEE Journal of Solid–State Circuits, vol. 25, No. 1, pp. 289–298, Feb. 1990.

Yang et al. "An Active–Feedback Cascode Current Source", IEEE Transactions on Circuits and Systems, vol. 37, No. 5, pp. 644–646, May 1990.

Zarabadiol et al. "Very–High–Output–Impedance Cascode Current Source/Current Mirrors/Transresistance Stages and Their Applications", International Journal on Circuit Theory and Applications, vol. 20, No. 6, pp. 639–648, Nov.–Dec. 1992.

Lee et al. "A Self–Calibrating 15 Bit CMOS A/D Converter", Proceedings of the IEEE Symposium on VLSI Circuits, pp. 33–34, Jun. 1990.

Lin et al, "A 13 bit 2.5MHz Self–Calibrating Pipeline A/D Converter in 3 mCMOS", Proceedings of the IEEE Symposium on VLSI Circuits, p p. 33–34, Jun. 1990.

Block3
VDD
GND
Bias Circuit
Up mirror
Reference Cell
Down Mirror
M1
M6
M8
M9
M18
M19
M20
M21
M22
M23
M24
M25
M26
M7
Vin1
Vout1
Vref1
Vref2
Iref
Iup
Idown
down mirror with Iout=Iref/16
D
C Reference Cell
Iin
I1
M1
Vref1
Iref
M2
Vref
VM5
VM3
M3
M4
M5
A
Vref
VM5
VM3
Up mirror
Vref
Vin
Vrd
M6
M9
M8
Iup
Vout
B
Vref
Vrd
Vout
Vin
Bias Circuit
M18
M19
I4
I3
M14
M15
M10
M11
Vin
Vout
VM5
VM3
C
Vout
Vin
VM5
VM3
D
Vr2
Vin2
Vin1
Vr1
Vout
Vrd
Down mirror 1
Vr1
M26
M27
M22
M25
M23
M7
M24
Iup
Vout
Idown1
Vr2
Vin2
Vin1
Vrd
Down mirror 2
Vr1
M26
M27
M22
M25
M23
M7
M24
Iup
Vout
Idown1
Vr2
Vin2
Vin1
Vrd
E
Vr2
Vin2
Vin1
Vr1
Vout
Vrd

CURRENT MIRROR AND/OR DIVIDER CIRCUITS WITH DYNAMIC CURRENT CONTROL WHICH ARE USEFUL IN APPLICATIONS FOR PROVIDING SERIES OF REFERENCE CURRENTS, SUBTRACTION, SUMMATION AND COMPARISON

This application claims priority benefit to U.S. Provisional Application No. 60/086,325, filed May 21, 1998.

DESCRIPTION

The present invention relates to current mirror circuits useful especially in analog and mixed-signal integrated circuits, and particularly to a current mirror circuit or topology that provides very high precision, design insensitive up and down mirrored current, excellent operation over a wide power supply range temperature insensitive precision, and the possibility of conveniently obtaining a wide range of current divisions. This topology is appropriate for those applications in which precise current handling and division is necessary, such as high accuracy A/D and D/A converters, reference cells, and high precision current comparators.

As background for the present invention reference is made to FIG. 1. In an up mirror the mirroring is made with respect to $V_{DD}$ and a down mirror is a current source in which the mirroring is made with respect to GND. The transistor that receives the input current is called the reference transistor, while the transistor that generates the output current is called the mirror transistor. In CMOS technology, the dependency of the output current ($I_{out}$) on the $V_{DS}$ variations of the mirror transistor strongly affects the precision of both current mirror configurations. These $V_{DS}$ variations are generated by factors such as load variations. Also, since the up mirror depends upon the P transistors and the down mirror depends upon the N transistors, due to the different characteristics of these two types of transistors, undesirable, different performance characteristics for the two types of mirrors is typically achieved in practice.

The value of the output current $I_{out}$ depends on the $V_{DSm}/V_{DSr}$ ratio where $V_{DSm}$ and $V_{DSr}$ are the drain to source voltages of the mirror and reference transistors respectively. Current mirror topologies were developed to reduce the dependency of the output current ($I_{out}$) on the $V_{DS}$ variations of the mirror transistor and on the $V_{DSm}/V_{DSr}$ ratio. One of these topologies is the current mirror employing active feedback, show, in FIG. 2 (See, H. C. YANG et al., *IEFE TRANS. Circuits & Systems,* 37, 5, p. 664 (May 1990)).

This invention provides a CMOS based topology for up and down current mirror circuits that maintains $$V_{DSr}=V_{GSr}=V_{DSm}=V_{GSm} \quad (1)$$

with a high precision, in order to obtain $I_{in}=I_{out}$ (when the mirror transistor is equal in size with the reference transistor) with high accuracy, and to reduce to minimum the $V_{DSm/VDSr}$ variations due to factors such as load, temperature, and power supply variations. The indices m and r in equation (1) refer to the mirror transistor and reference transistor, respectively.

This invention also provides a down current mirror matched in performance with an up current mirror, namely to provide up and down current mirrors that satisfy equation (1) with the same accuracy, eliminating any dependencies on the involved (N or P) transistor types. Since the same mirroring error is obtained for both the up and the down current mirror while $I_{in}=I_{out}$, a circuit according to the invention provides an ability to shift between the up and down current sources, herein called the ping-pong facility. This capability consists of identically mirroring the current with respect to $V_{DD}$ and with respect to GND, useful in a multitude of applications such as current mode A/D and D/A converters in which the ping-pong facility can be used to generate and manipulate the reference currents.

This invention can provide circuitry obtaining a series of high precision reference currents using the up and down current mirrors and the ping-pong facility, such circuitry being useful in applications such as high precision current mode A/D and D/A converters.

This invention also can provide a high precision current summator, a high precision current subtractor, as well as a high precision current comparator with direct digital output based on the introduced up and down current mirrors, ping-pong facility, and a series of high precision reference currents.

Briefly described, the invention provides both up and down current mirrors, using active feedback and similar biasing and sizing throughout the circuit to implement equation (1). For both up and down mirrors, the mirror transistor is followed by a buffer transistor that supports the output voltage variations due to the load variations and provides the current output.

The invention, and the features and advantages provided by the invention will become apparent from a reading of the foregoing and the following description in connection with the accompanying drawings, wherein.

Figure 5A:
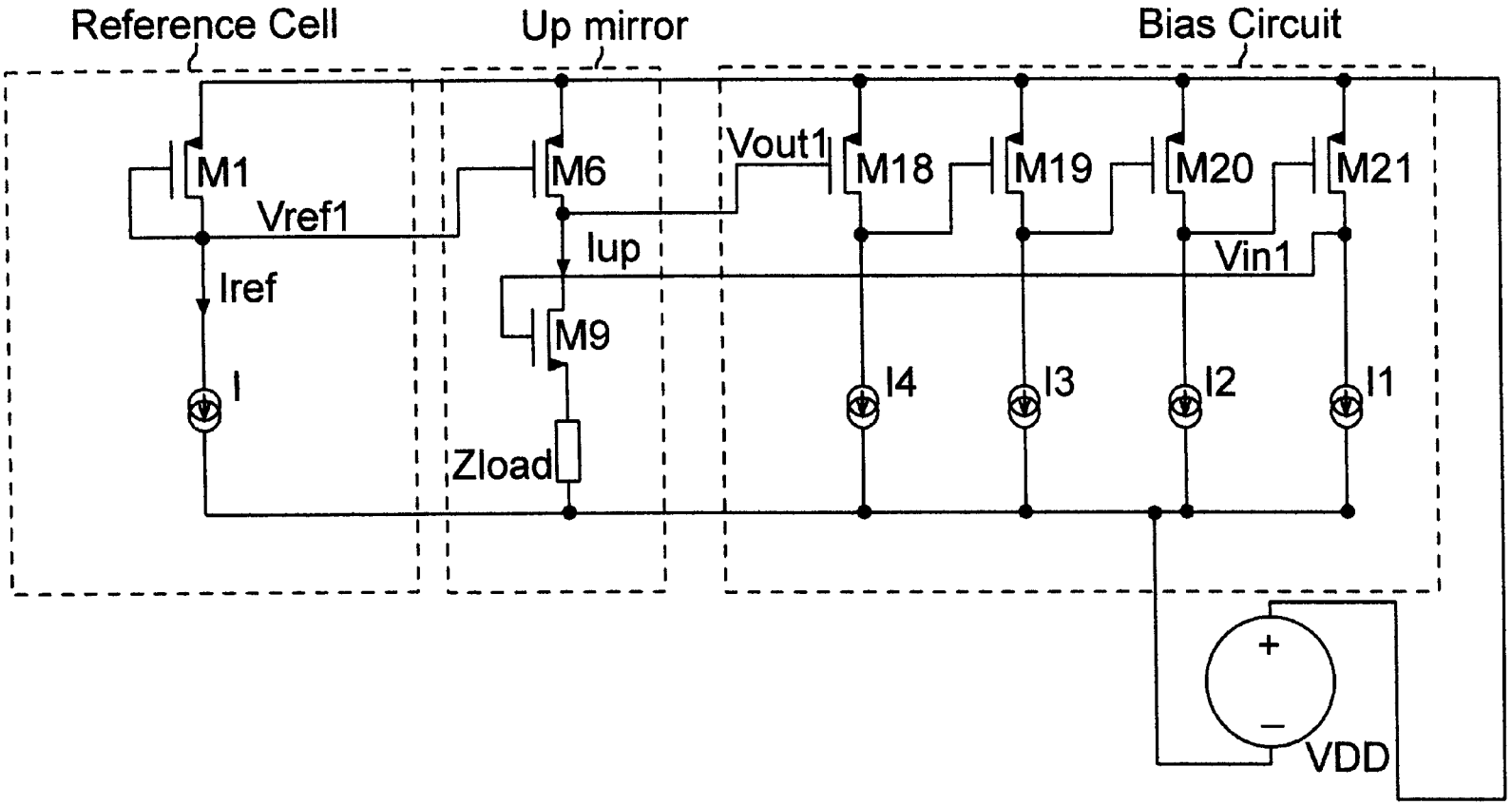

FIGS. 5A and B are simplified transistor-level schematics of the a) up current mirror and b) down current mirror circuit, according to the present invention, respectively.

Figure 6:
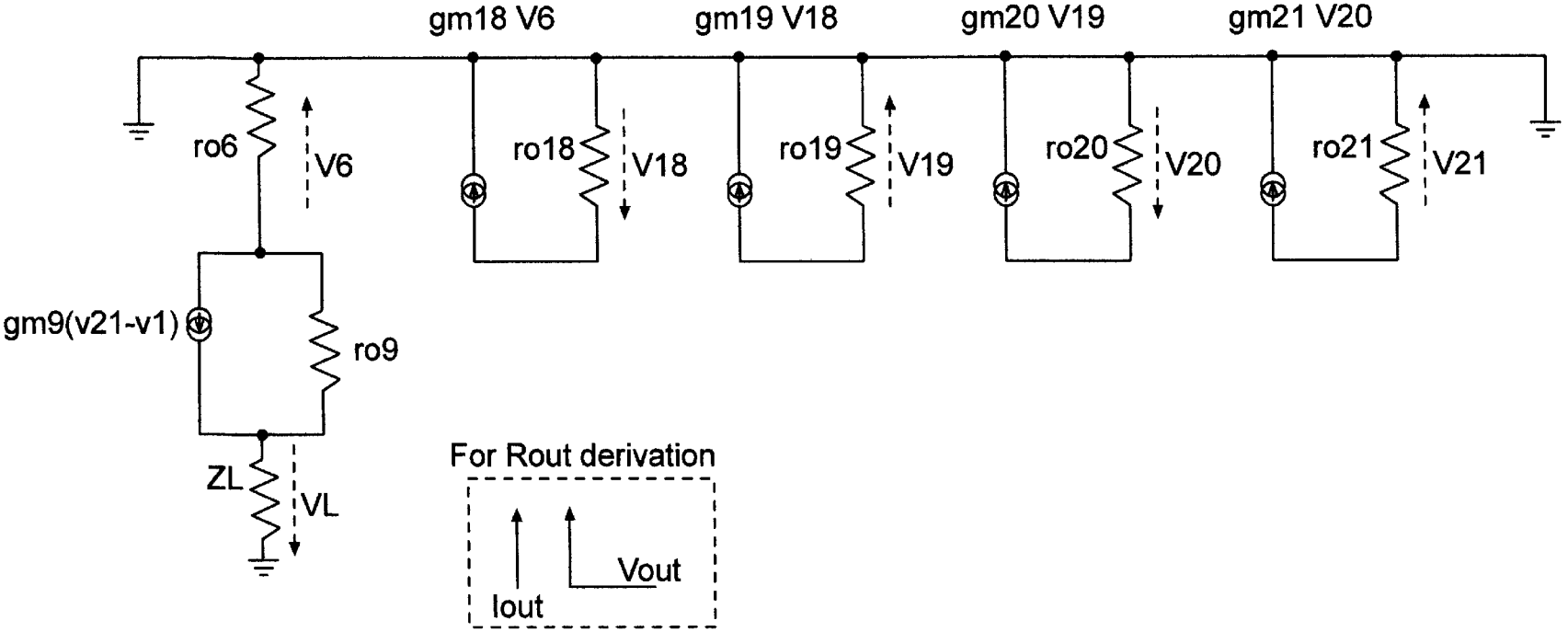

FIG. 6 is a small signal equivalent schematic of the up mirror circuit at low frequency, which circuit is according to the present invention.

Figure 7:
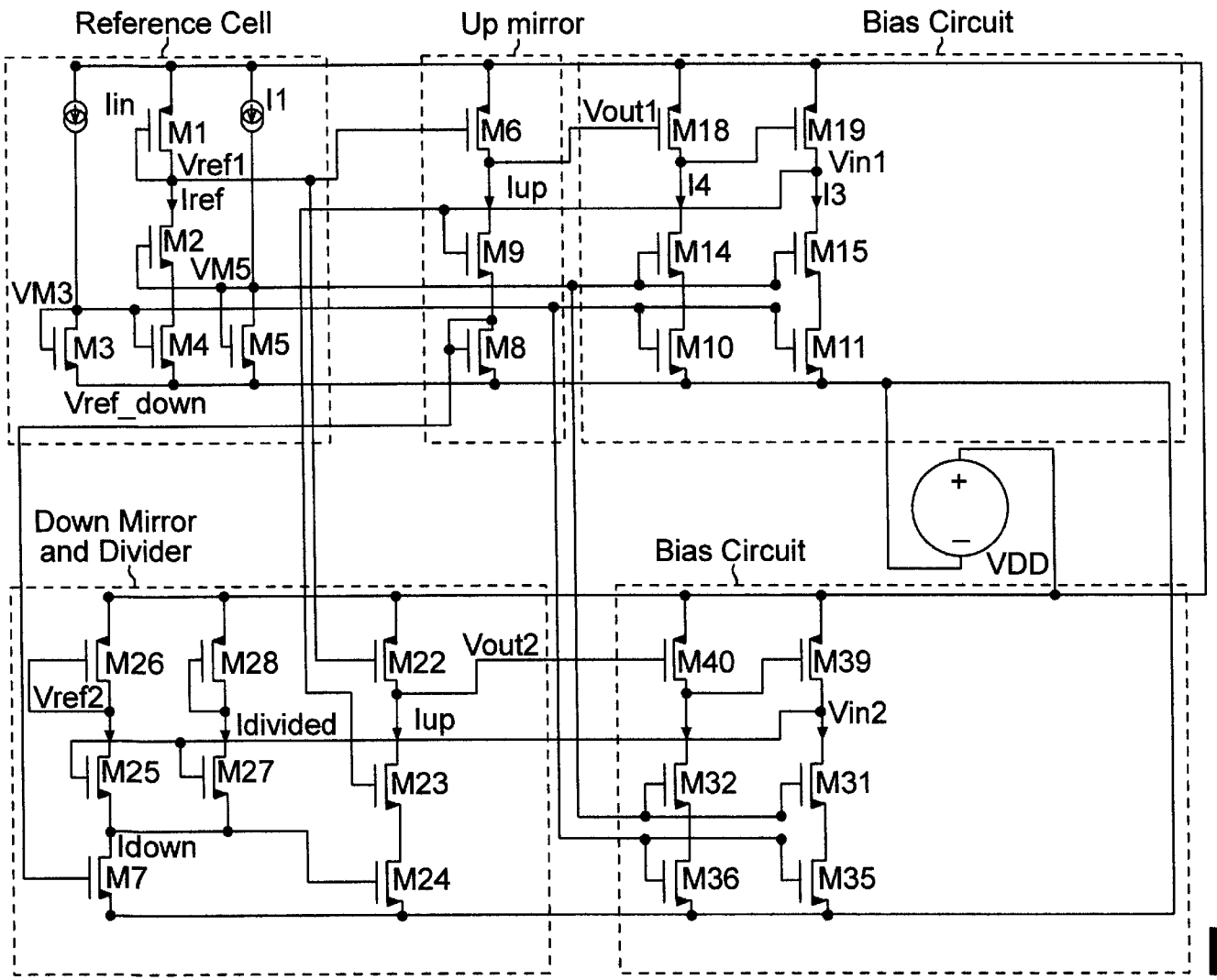

FIG. 7 is a transistor-level schematic of a CMOS current mirror/divider circuit with a two section bias circuit, according to the present invention.

Figure 8:
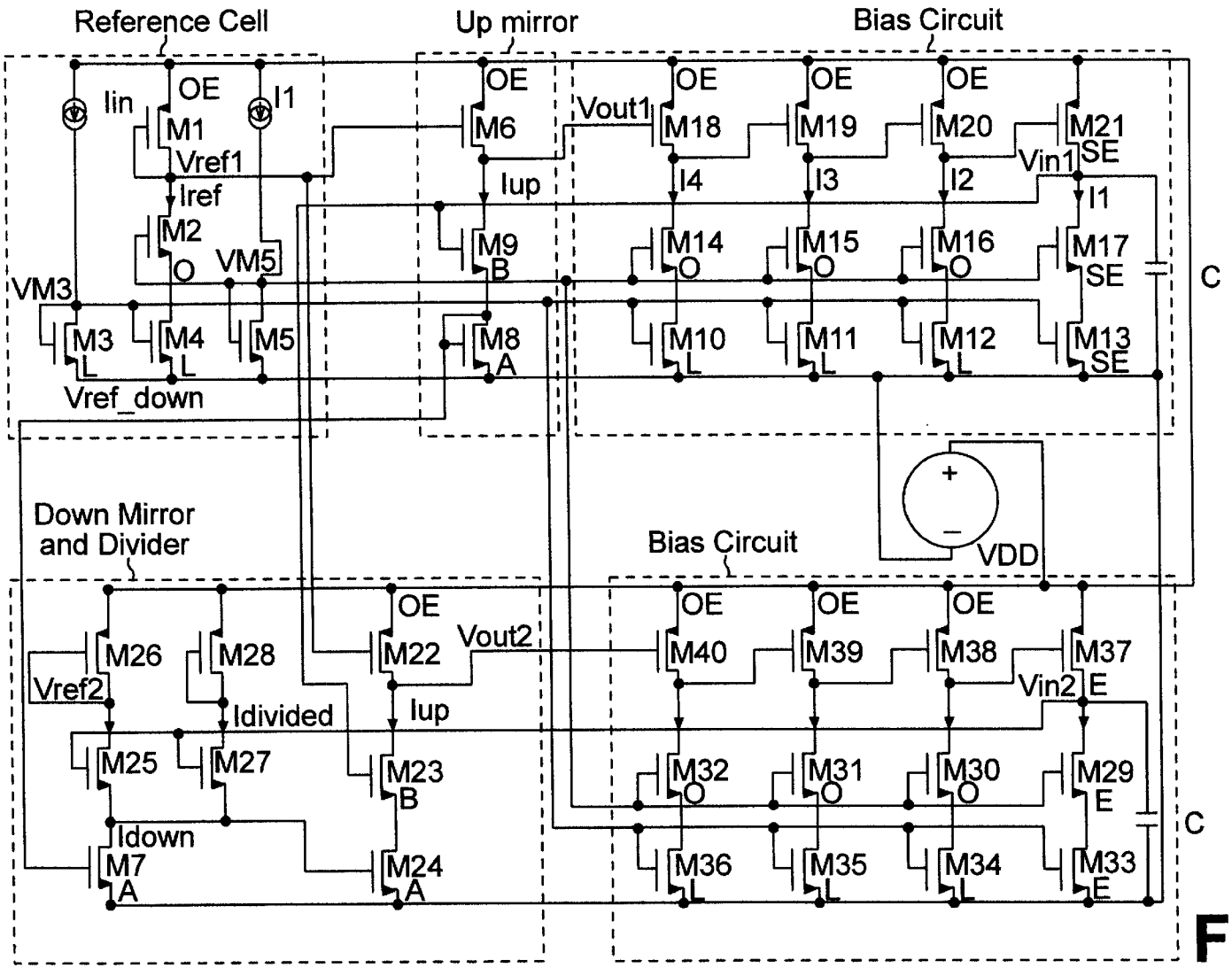

FIG. 8 is a transistor-level schematic of a CMOS current mirror/divider circuit sized for efficient frequency compensation, which circuit is according to the present invention.

Figure 9:
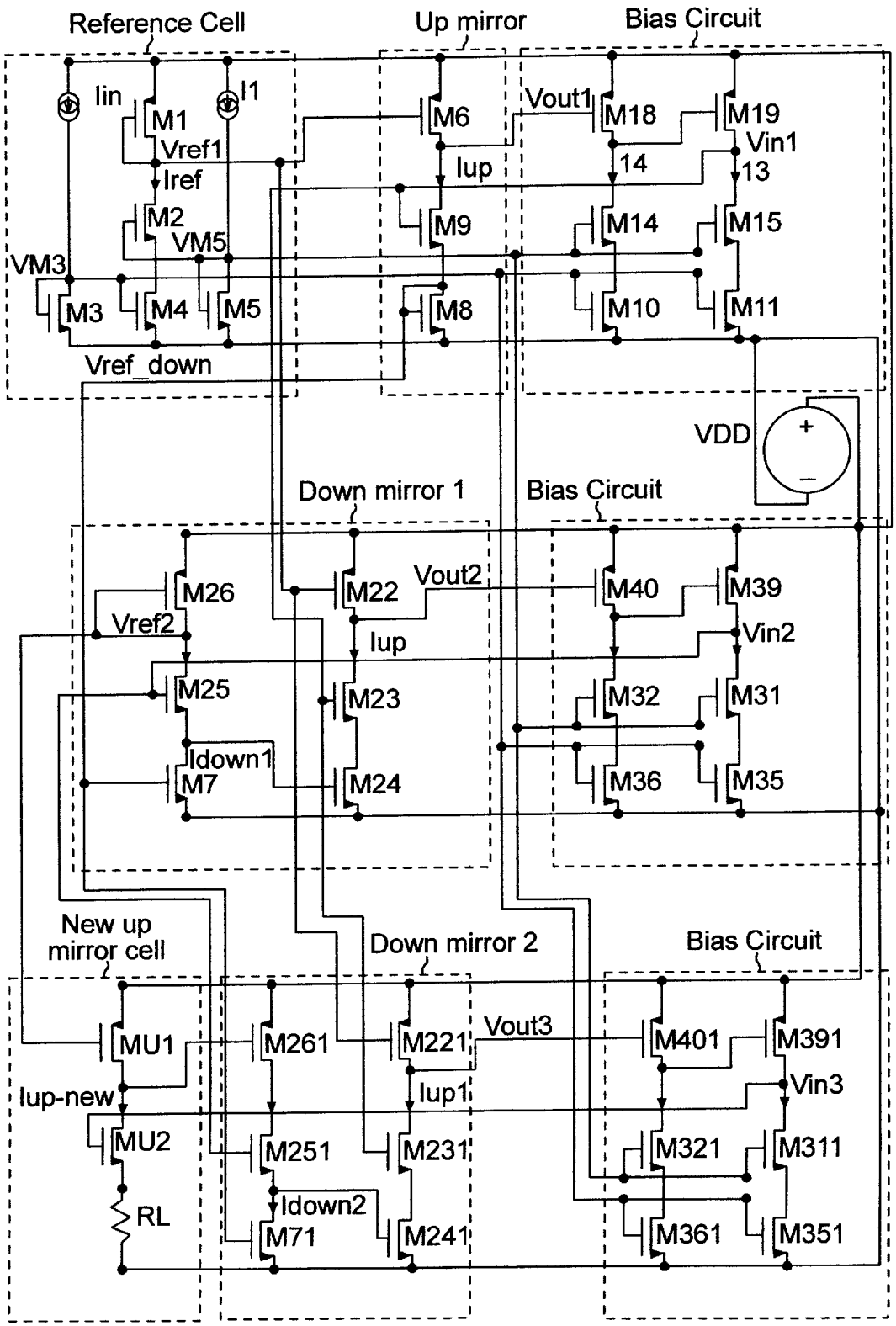

FIG. 9 is a transistor-level schematic of another up mirror circuit, according to the present invention.

Figure 10:
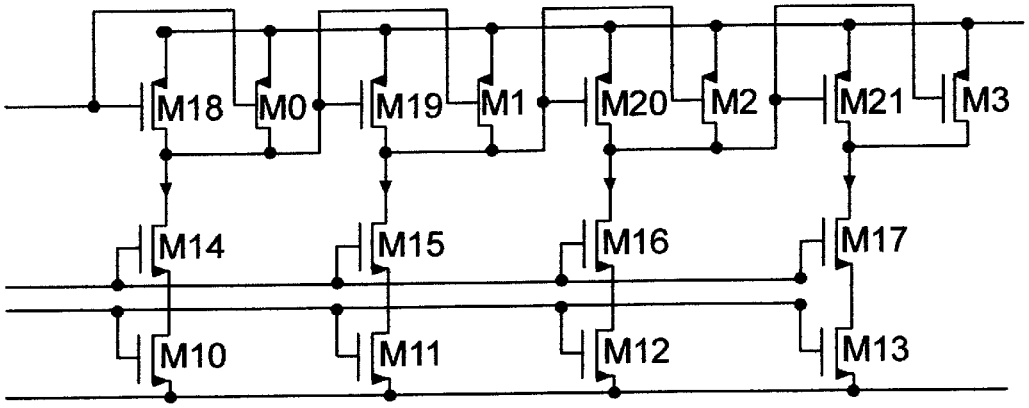

FIG. 10 is a bias circuit used after a division, according to the present invention.

Figure 11:
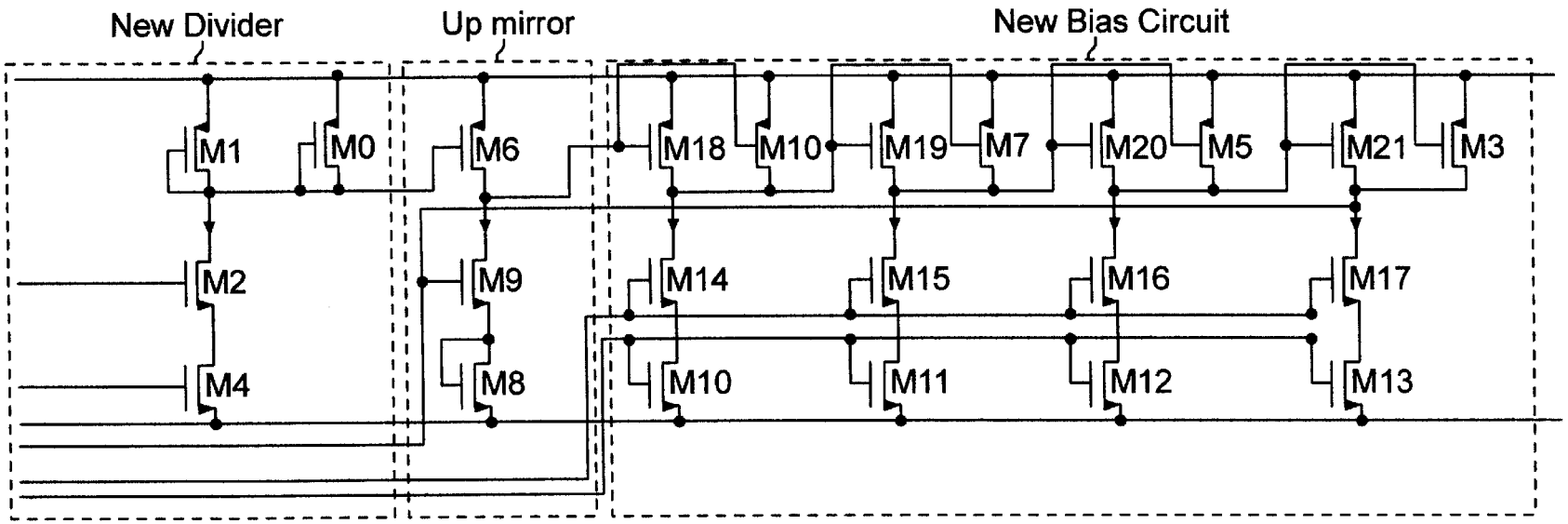

FIG. 11 is a schematic of a circuit which implements division where the transistors are essentially alike, i.e., M0=M1=M3=M5=M7=M10=M18=M19=M20=M21, according to the present invention.

Figure 12A:
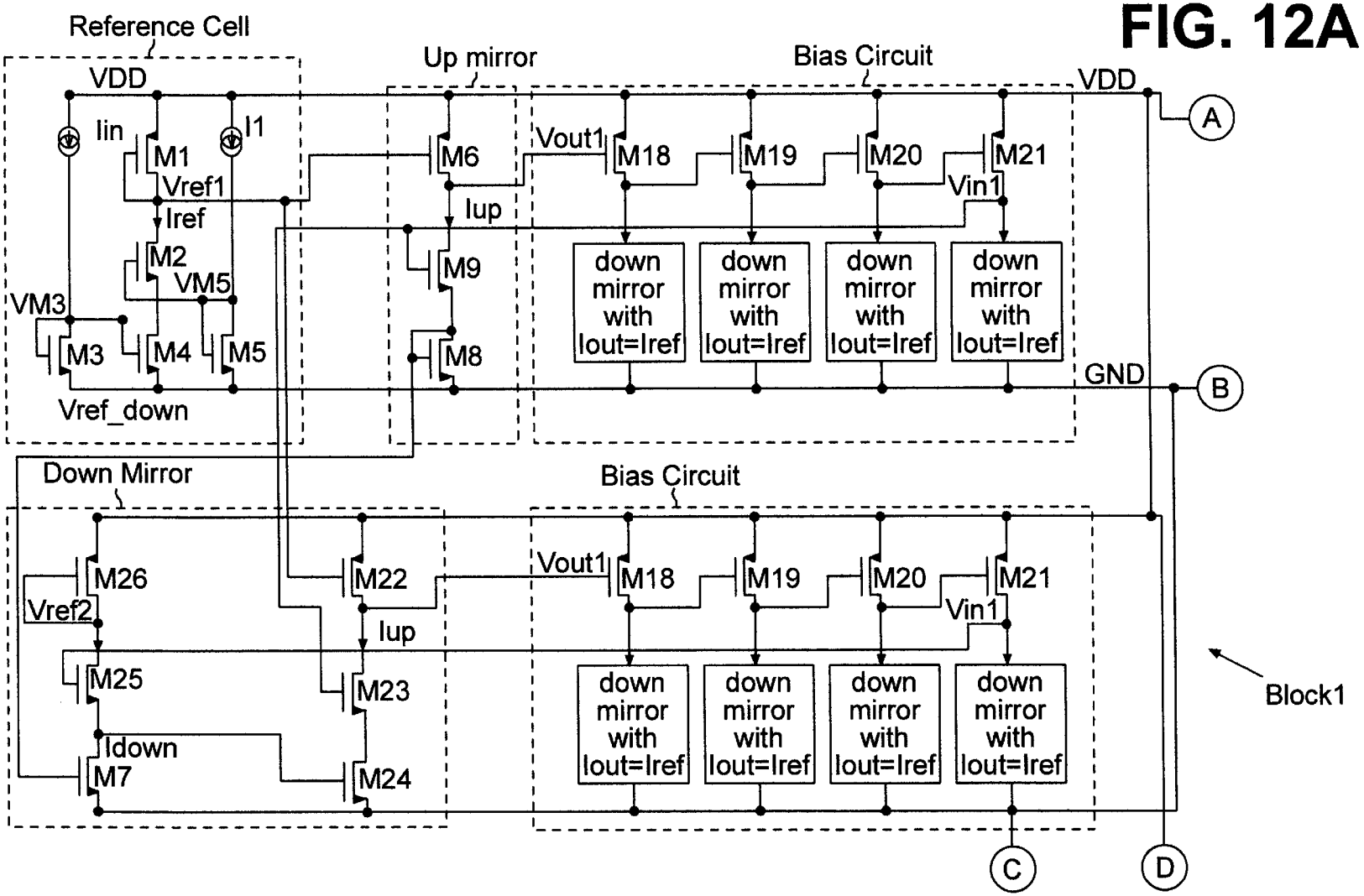
Figure 12B:
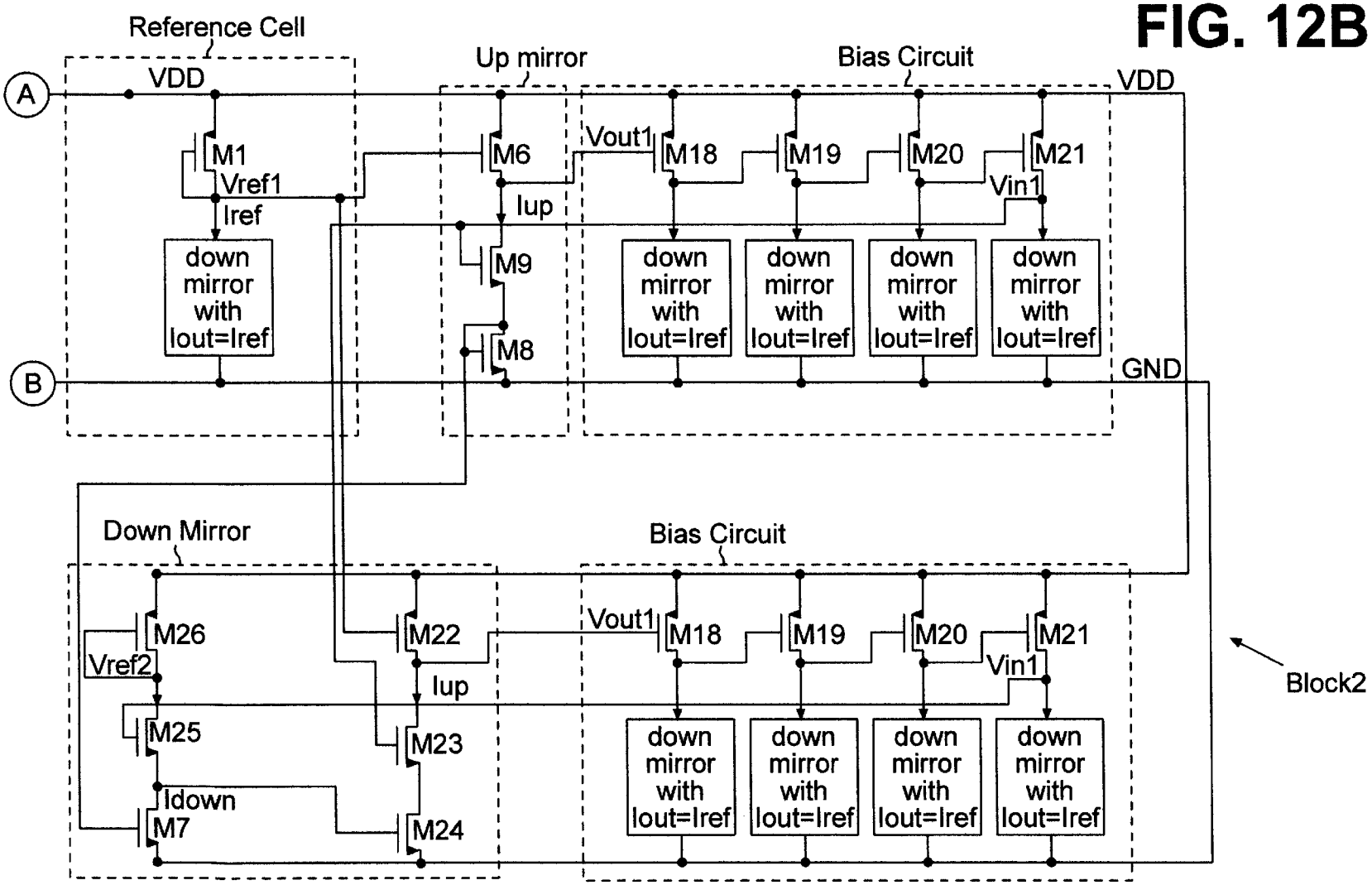
Figure 12C:
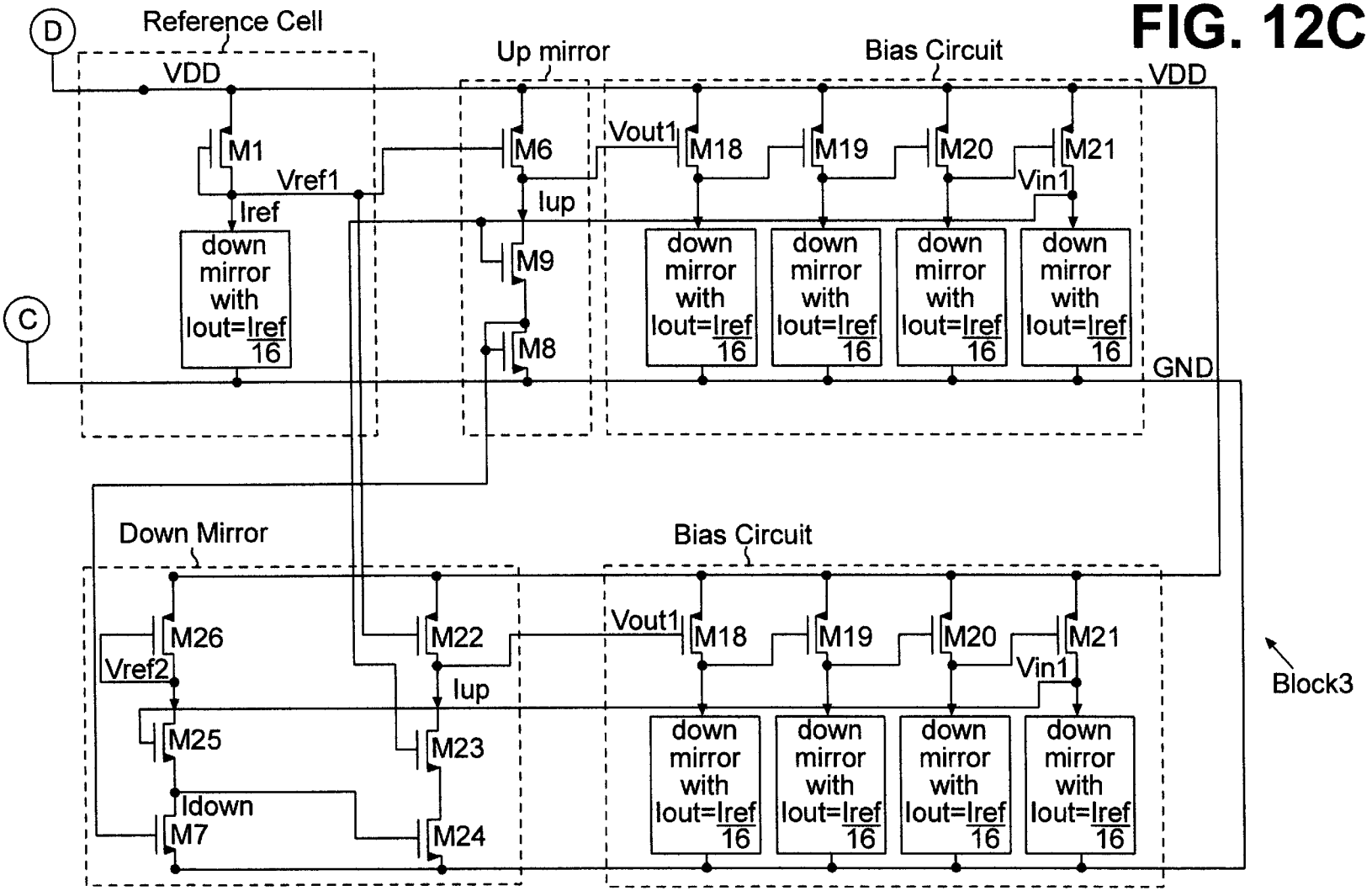

FIG. 12 shown as FIGS. 12A–C, connected at connectors A to D is the schematic of a circuit using a plurality of blocks with a plurality of up mirror, bias current, down minor, and divider cells to obtain a series of high precision reference currents, according to the present invention.

Figure 13A:
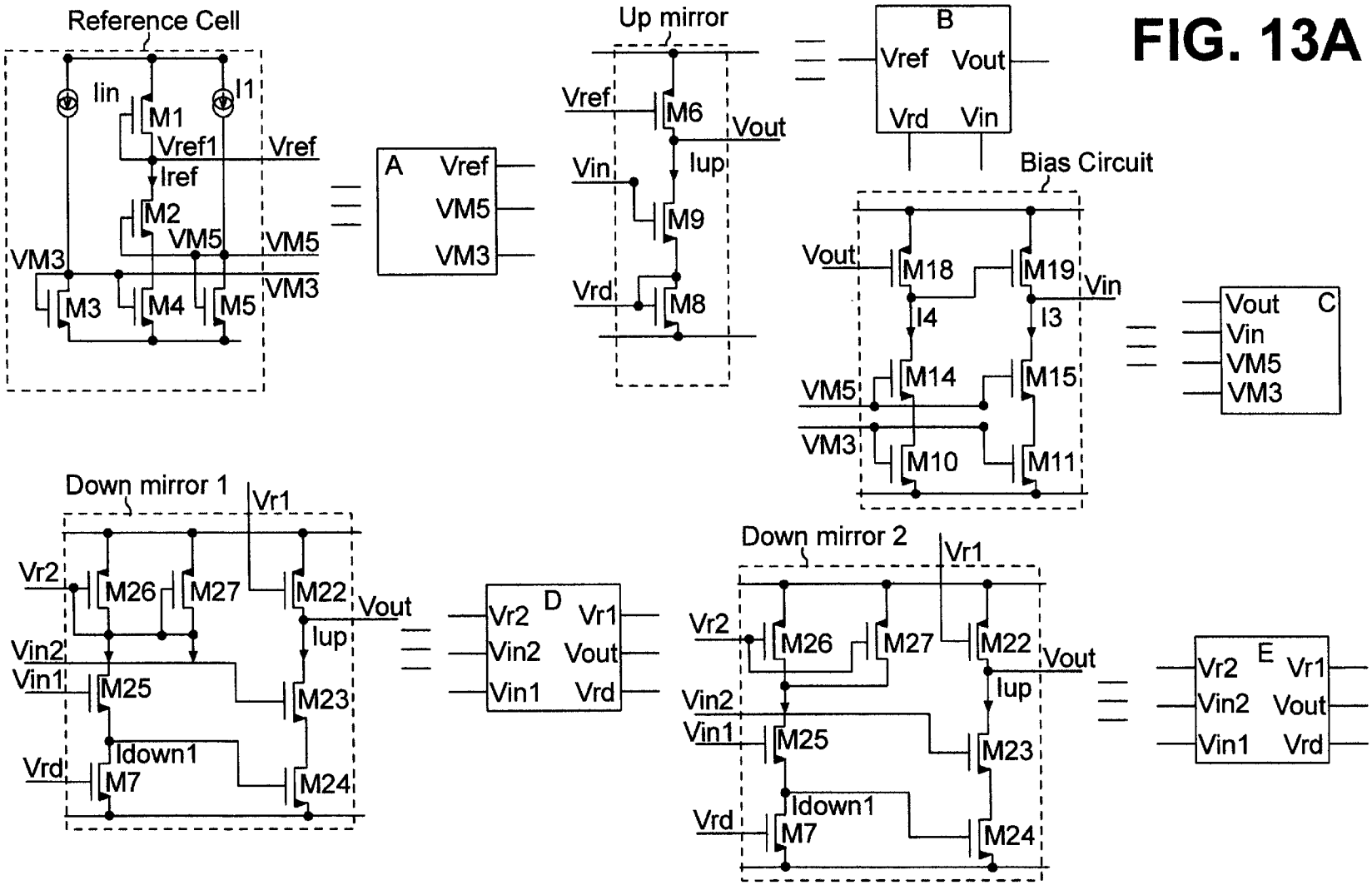

FIGS. 13A and B is a schematic in block form, where the circuits of block A–E are shown expanded as FIG. 13A part of the figure, for obtaining a series of precision reference currents, according to the present invention.

Figure 14A:
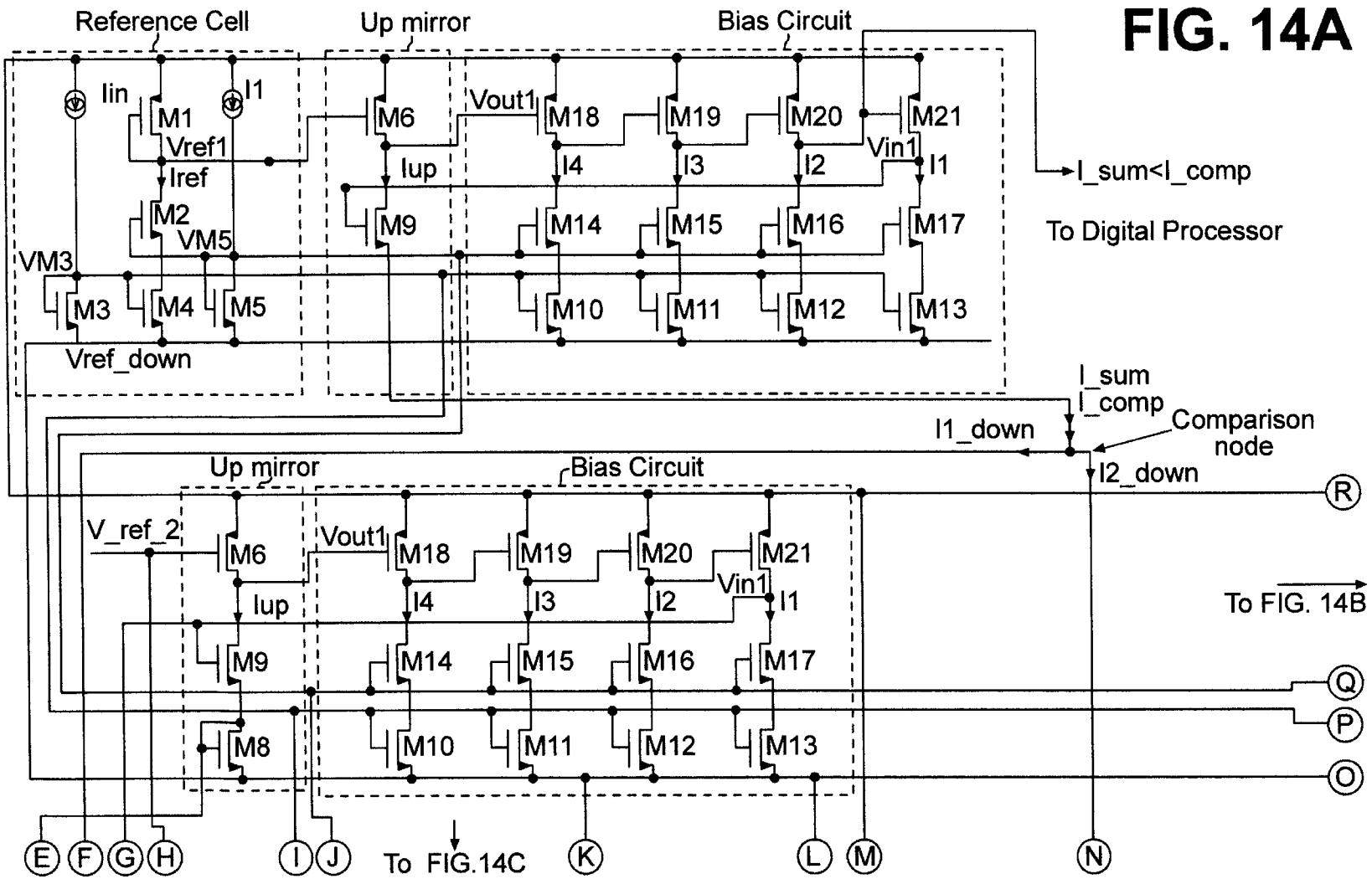
Figure 14B:
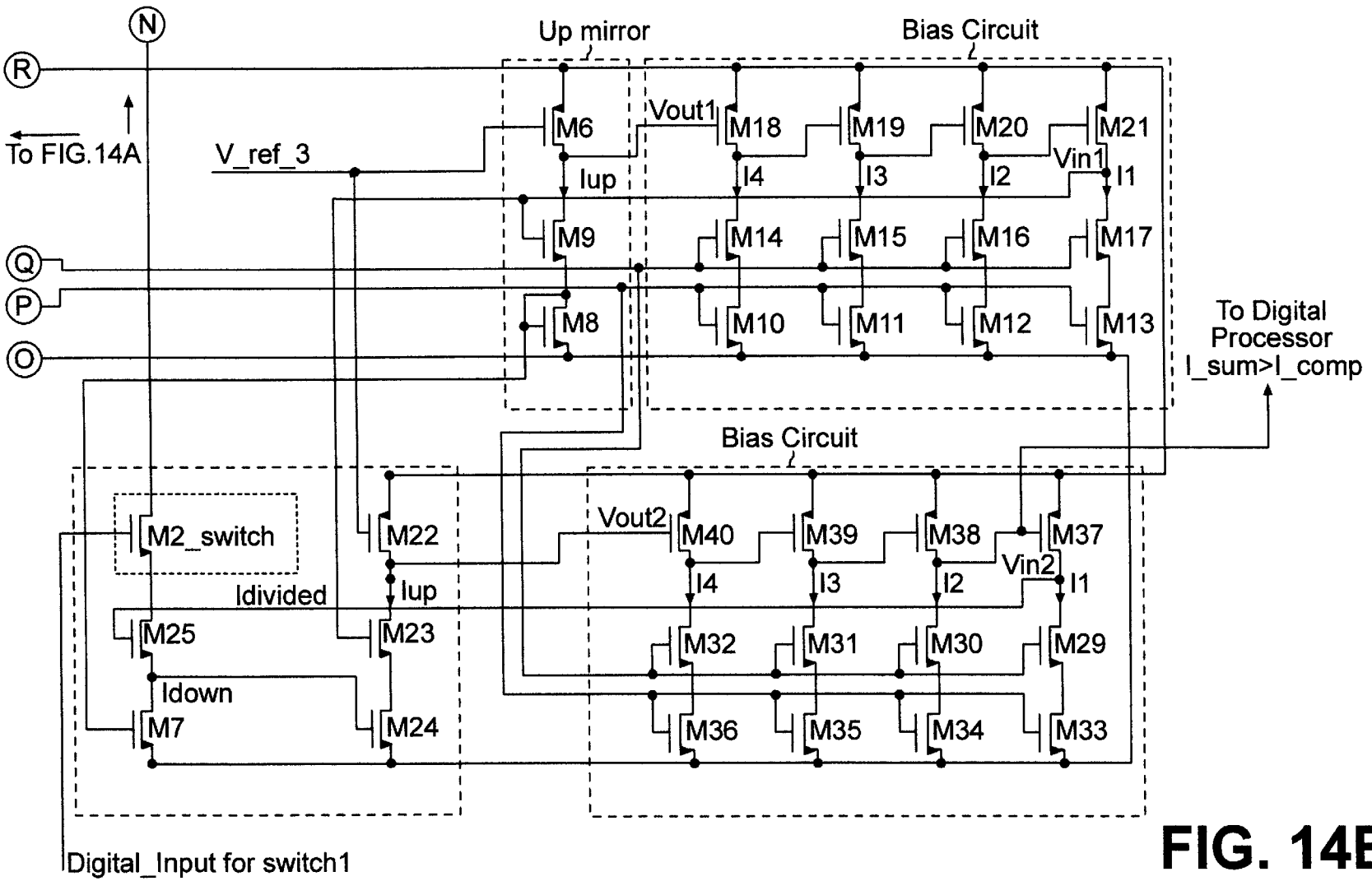
Figure 14C:
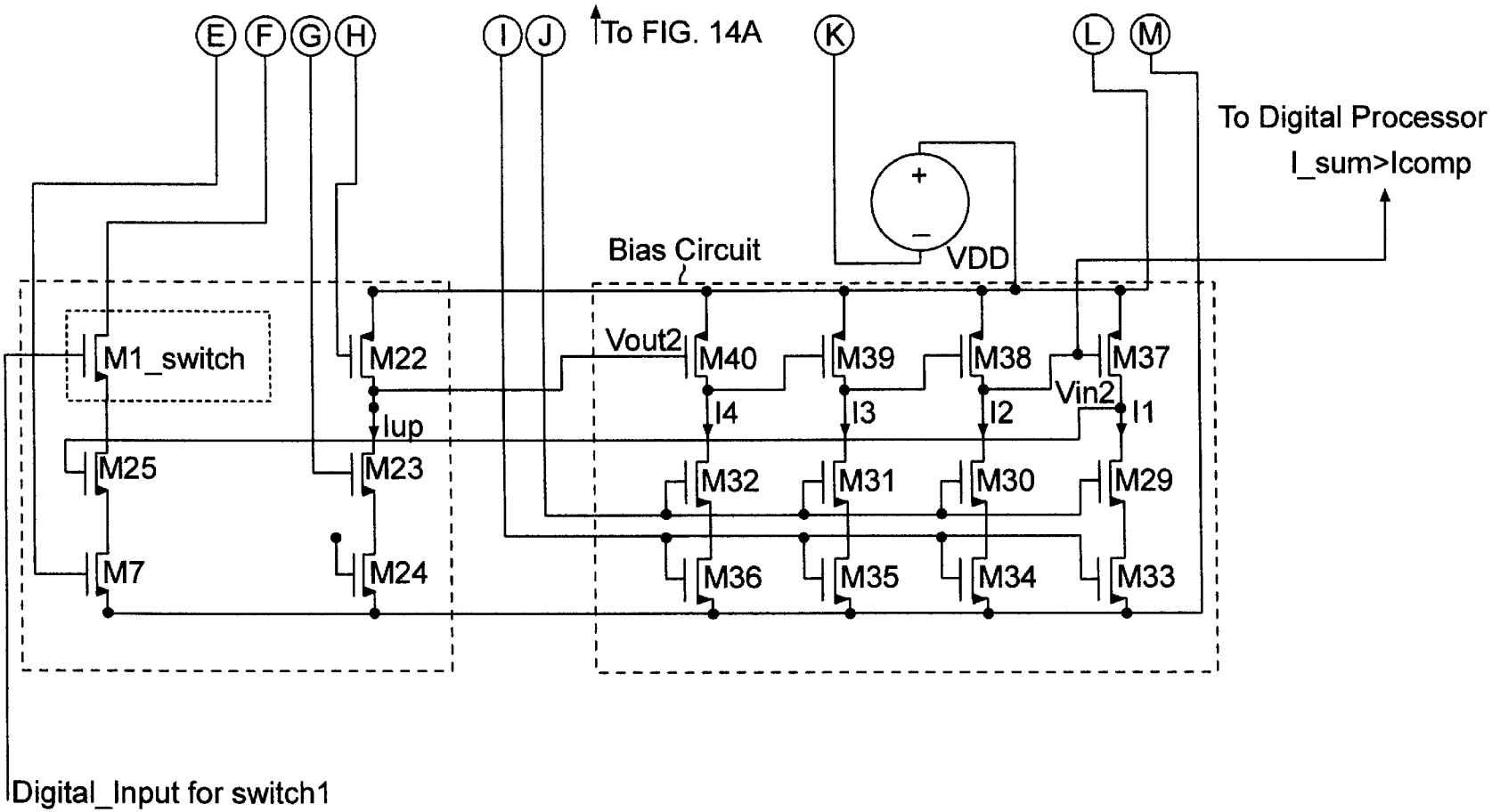

FIG. 14 shown as FIGS. 14A–C, connected at connectors A–R, is the block schematic of a current comparator circuit containing a two current down summator with switches, according to the present invention.

Figure 15:
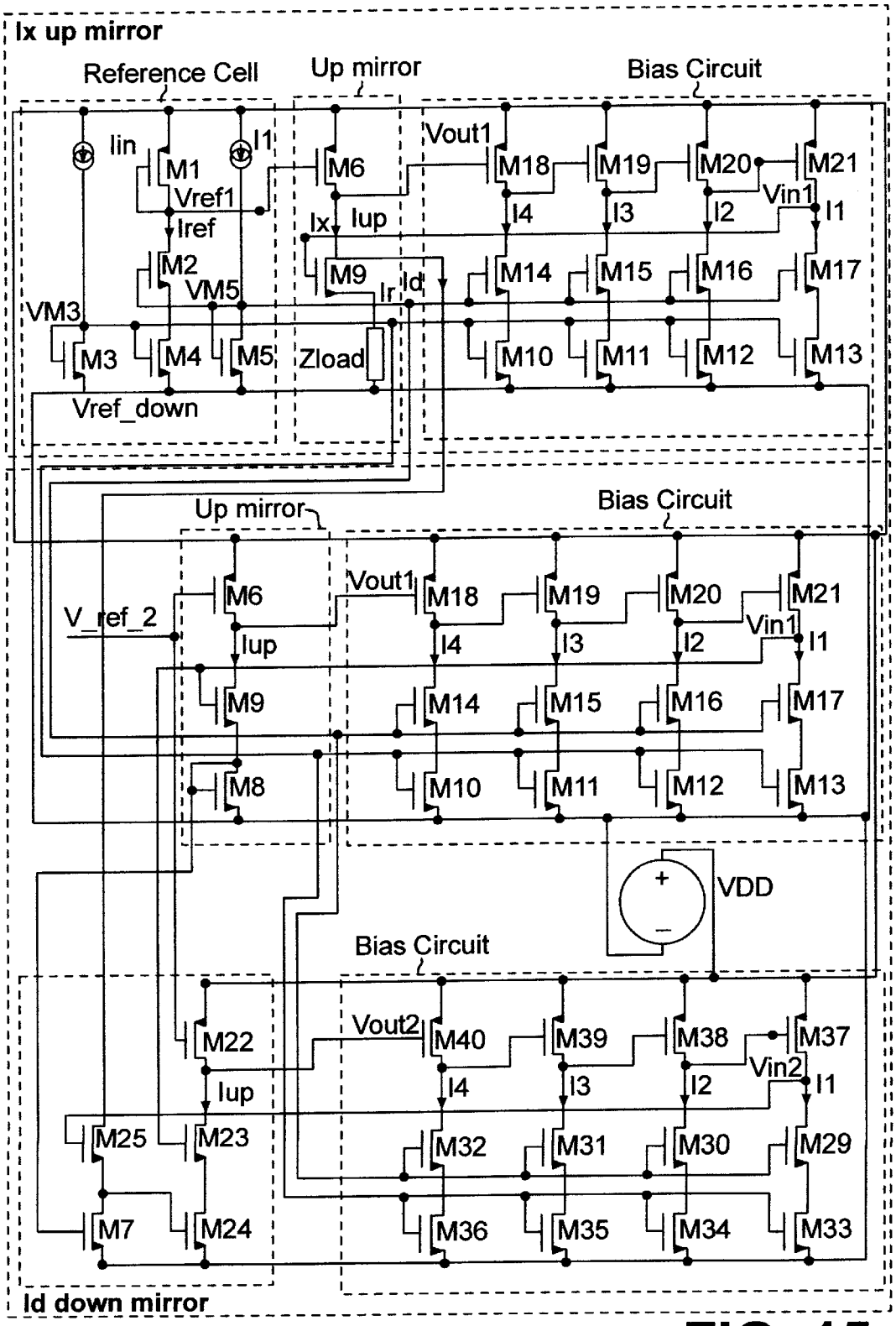

FIG. 15 is a schematic of a current subtractor, according to the present invention.

Figure 3:
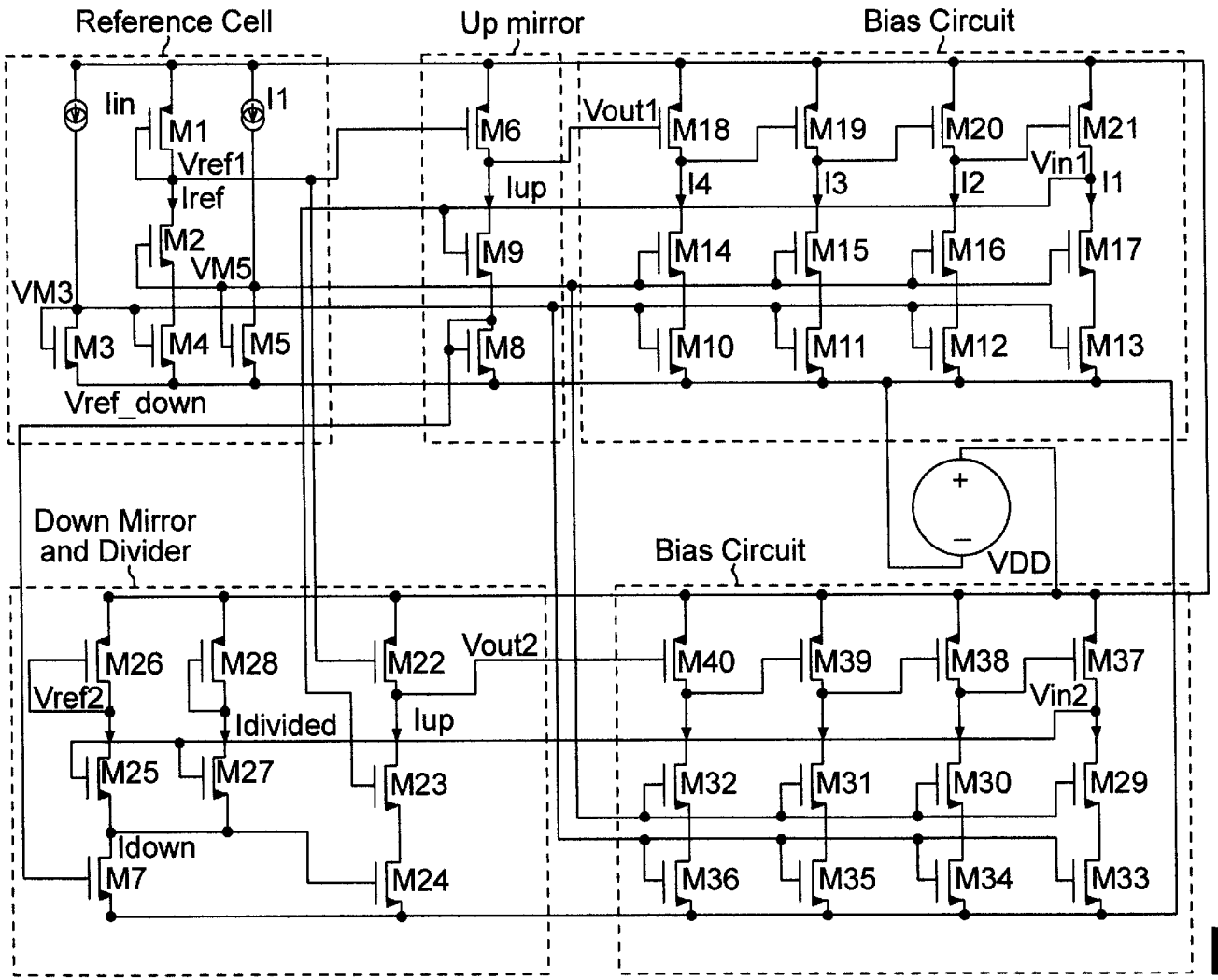
FIG. 3 is a transistor-level schematic of a CMOS current mirror/divider circuit, according to the present invention.

The topology of the current mirror/divider, including the up mirror, the down mirror matched in performance with the up mirror, and the divider, is shown in FIG. 3. Several distinct functional blocks or cells can be distinguished. These blocks include (a) the reference cell that provides the reference voltages and currents for the entire circuit, (b) the up mirror cell that mirrors the current up, (c) the down mirror and divider cell that mirrors the current down and properly divides the current according to the application, and (d) the bias circuit cell. As shown, an identical bias circuit is used for the up mirror as well as for the down mirror. Since the bias circuit dictates the performance of the current mirror, matched performance for the up and down mirror is obtained, thereby eliminating the performance dependency on the transistor parameters.

A symmetric topology may alternatively be used in FIG. 3 and may be used throughout, in all the figures herein. The symmetry refers to the use of PMOS transistors instead of NMOS transistors and of NMOS transistors instead of PMOS transistors.

M1, M2, M3, M4, and M5 constitute the reference cell. M3 and M5 provide the two reference voltages, $V_{M3}$ and $V_{M5}$. $I_{DSM1}$ is the initial reference current that is mirrored and divided. As shown in FIG. 3, M1 and M8 are the reference transistors, and M6 and M7 are the mirror transistors for the up mirror and down mirror, respectively M9 is the buffer transistor. In order to obtain the same mirrored current, the mirror transistors must ideally have the same $V_{GS}$, $V_{DS}$, and W/L (width/length of the channel) as the reference transistors, permitting both devices to satisfy the same basic I–V equation, $$I_{DS}=KW/L(V_{GS}-V_T)^2(l+\lambda V_{DS}), \quad (2)$$

with $V_{GS}=V_{DS}$. In FIG. 3, $V_{DSM1}=V_{GSM1}=V_{GSM6}$ and $V_{DSM8}=V_{GSM8}=V_{GSM7}$. In order to satisfy the above equation for the reference and mirror transistors, the equality conditions, $V_{DSM6}=V_{GSM1}$ and $V_{DSM7}=V_{GSM8}$ obtain. To provide matched performance between the up and the down mirrored currents, the above noted equality conditions for the up and down mirror transistors (M6 respectively M7) are obtained, employing the same circuitry for the up and down mirrors, as shown in FIG. 3.

Figure 4:
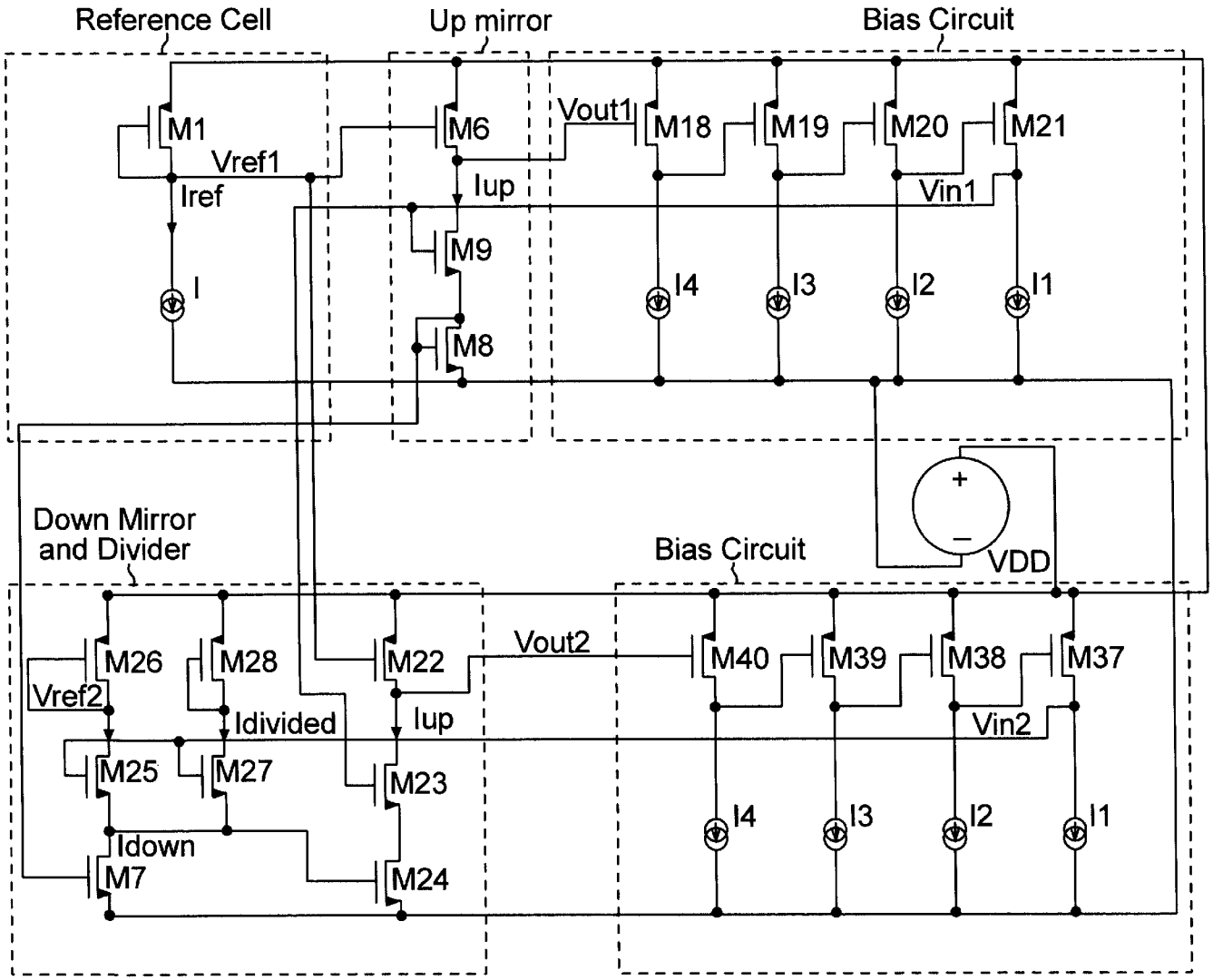
FIG. 4 is a simplified transistor-level schematic of a CMOS current mirror/divider circuit, according to the present invention.
Figure 5B:
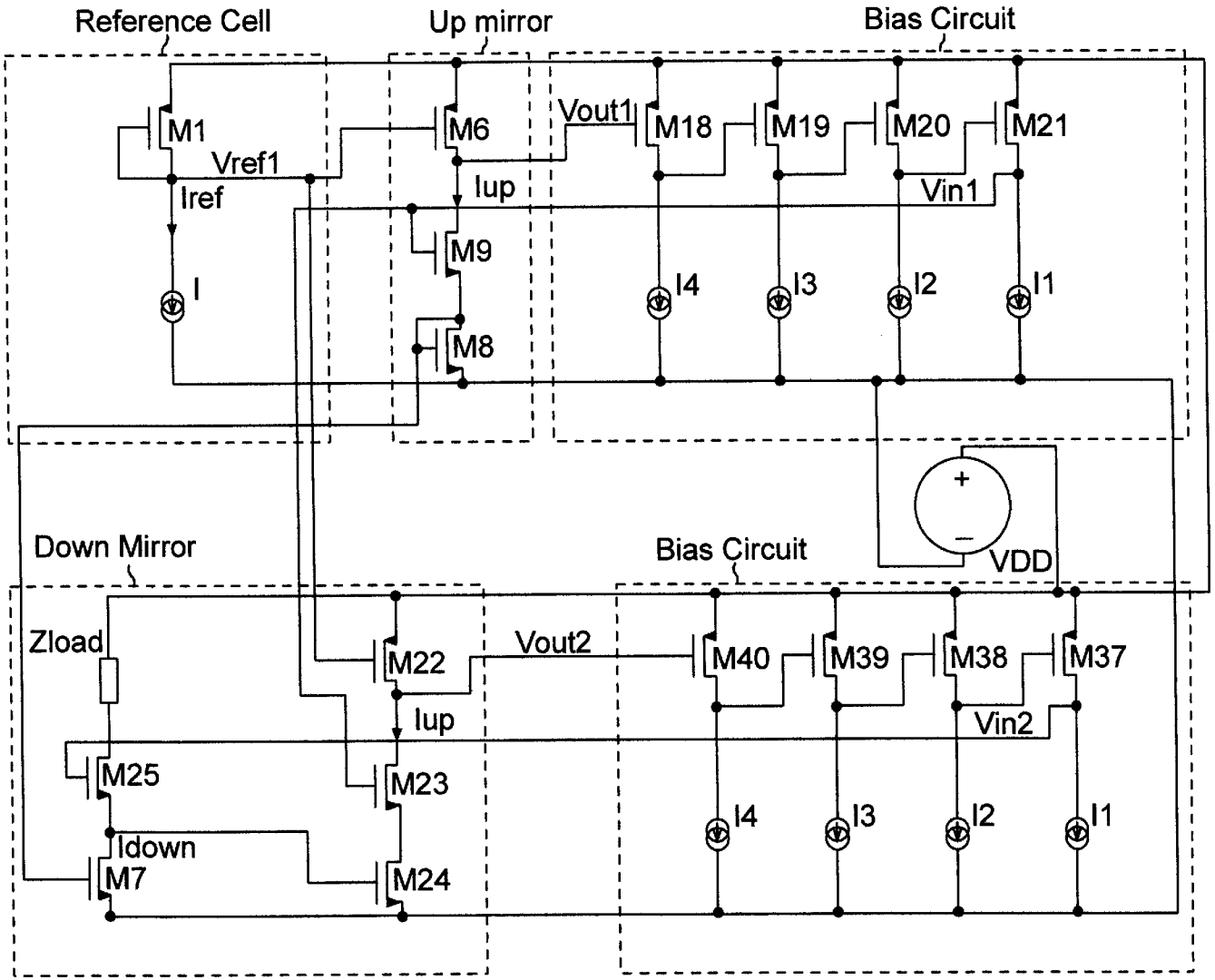

A simplified version of FIG. 3 is shown in FIG. 4 for use in the following discussion. The simplified versions of the up mirror and down mirror driving an arbitrary load, are shown in FIG. 5. The biasing currents shown in FIG. 4, I, I1, I2, I3, and I4 are implemented with similar and similarly loaded cascode current sources. The higher the output resistance of the I1, I2, I3, and I4 current sources, the higher the precision of the up and down current sources. Regarding the up mirror of FIG. 5, due to the variations in the load impedance, $V_{load}=V_{outup}$ varies, making $V_{in1}=V_{dsm21}$ vary in the same magnitude. Each stage of the bias circuit reduces these variations, reaching $V_{out1}=V_{ref1}$. I1, I2, I3, and I4 are incrementally closer to $I=I_{ref}$.

Referring in FIGS. 3, 4, 5 to the up mirror, the feedback loop is between the gate of M9 and the drain of M9 through the bias circuit. For the DC analysis, it is considered that the input corresponds to the gate of M9, and the output corresponds to the drain of M9. When the circuit operates in open loop, the drain of M9 is floating. When the circuit operates in closed loop, all the transistors are properly biased and the required $V_{DSM6}$ is obtained. Regarding the bias circuit, the manner in which the loop is closed may be considered. Assume initially that $V_{GSM9}$=>0($V_{GSM9}<V_T$) such that the current through M6, M9, and M8 is zero. M10–M13 and M14–M17 are biased with $V_{M3}$ and $V_{M5}$, respectively. The above bias situation forces $V_{DSM13}=V_{DSM17}=0$ ($I_{DS}=0$). Since $V_{DSM21}=V_{DD}$, $V_{GSM21}$ is smaller than the threshold voltage $V_T$. Consider bias on M12–M16–M20. Due to the M12–M16 bias, a large current must flow through M20, which is not possible with $V_{DSM20}$=>(M20 is in the linear region). However, it is possible for M20 to sink the required current if $V_{GSM20}$=>$V_{DD}$. Applying the same approach, $V_{GSM19}$=>0 and $V_{GSM18}$=>$V_{DD}$ are obtained, which forces $V_{DSM6}$=>$V_{DD}$, biasing M6 to supply a large current. However, consider that initially $I_{DSM6}$=>0. Note that a large $I_{DSM6}$ is required to close the loop, creating a contradiction in the circuit operation. A complementary situation, starting with $V_{DSM9}$=>$V_{DD}$, also creates a similar contradiction within the loop. To remove this contradiction, $V_{GSM9}$, the input to the bias circuit, is selected to have a specific value between ground and $V_{DD}$, such that the loop is properly closed and all the transistors are appropriately biased.

Note that $V_{out}=V_{GSM18}$ reaches the required value, namely $V_{GSM1}$, due to the similarities in the biasing of the M1–M2–M4 and M10–M14–M18 circuits, similar sizing, and the feedback loop. By evaluating FIG. 4 and considering the previous discussion of the loop, it can also be noted that, once the equilibrium state is reached ($V_{DSM6}=V_{GSM1}$), an increase in $I_{DSM6}$ increases $V_{GSM9}$, which decreases $V_{DSM21}$, increases $V_{GSM21}$, decreases $V_{GSM20}$, increases $V_{GSM19}$, decreases $V_{GSM18}$, which finally decreases $I_{DSM6}$, returning to the state of equilibrium. An initial decrease in $I_{DSM6}$ will result in an increase in $I_{DSM6}$, again returning to the state of equilibrium $V_{DSM6}=V_{GSM1}$. In bias circuit the following three groups of transistors are identical: M4 and M10–M13, M2 and M14–M17, and M1, M6, and M18–M21.

For the down mirror, two identically dedicated bias circuits are used. M8=M24=M7 and M9=M23 is desirable for circuit operation. M22 (see FIG. 3) is similar to the mirror transistor M6 of the up mirror, giving $I_{DSM22}=I_{DSM1}$. This current biases the M22–M23–M24 column such that $V_{GSM24}=V_{DSM7}=V_{GSM8}$, making $I_{DSM7}=I_{DSM1}=I_{DSM6}$. Note that the M22–M23–M24 column biases the mirror transistor of the down mirror, M7, to obtain the $V_{DSM7}=V_{GSM8}$ equality. M23, M25 and M27 are buffer transistors. M25 and M27 connect the bias circuit of M29 to M40 in feedback relationship with mirror transistors 26 and M28. Similarly, M23 connects the bias circuit of M10 to M21 in feedback relationship with mirror transistor M22.

The small signal equivalent schematic of the up mirror of FIG. 5 at low frequencies is shown in FIG. 6. Due to the similar biasing, $g_{m18}=g_{m19}=g_{m20}=g_{mp}$ and $r_{o19}=r_{o20}=r_{o21}=r_{o6}=r_{op}$. To determine the gain of the up mirror, the feedback loop is broken at the gate of the M18 transistor, where an input signal $V_{in}$ is introduced. The output voltage $V_{out}$ is the $V_6$ voltage shown in FIG. 6. Accordingly, the gain of the loop is given by $$\frac{V_{out}}{V_{in}} \approx -\frac{g_{mp}^4 r_{op}^5 g_{m9} r_{o9}}{z_l + r_{o9} + g_{m9} z_l r_{o9} + r_{op}} \propto -g_m^4 r_o^4. \tag{3}$$

while the output resistance of the up mirror is given by $$R_o = \frac{V_{out}}{V_{in}} \approx g_{mp}^4 r_{op}^5 \propto g_m^4 r_o^5 \tag{4}$$

Similarly to the up mirror, the gain for the two feedback loops and the output resistance for the down mirror are determined as $$\frac{V_{out}}{V_{in}} \approx -g_{m8} g_{mp}^4 r_{op}^5 \propto -g_m^5 r_o^5 \tag{5}$$

approximately similar for the two loops and $$R_o = \frac{V_{out}}{V_{in}} \approx g_{m8} r_{o8} g_{m9} r_{o9} g_{mp}^4 r_{op}^5 \propto g_m^6 r_o^7 \tag{6}$$

for the output resistance of the down mirror. Note that both the gain and the output resistance for the down mirror are larger than the gain and the output resistance of the up mirror. Also note that the gain of the two loops of the down mirror is similar.

An analysis of the transfer functions of the three feedback loops at high frequencies shows that each loop has four dominant poles approximately situated at $\omega=1/c_1 r_{op}$, where $c_1$ is the gate to source capacitance of the similarly sized PMOS transistors of the bias circuit.

Note that as the size of the PMOS transistors increase, the gain of the loops increases through $g_{mp}$, and the gate to source capacitance, $c_{gs}$ ($c_1$) increases, decreasing the frequency of the poles. These effects make the discussed loops more difficult to compensate. Accordingly, small transistor sizes and large currents produce a smaller gain and higher frequency poles making the frequency compensation process easier. However, there are situations when, if the dominant pole frequency compensation method is used, the frequency compensation capacitor (such as a capacitor connected between the drain of any PMOS transistor of the bias circuit and GND, for example between the drain of M21 and GND) may become prohibitively large to be monolithically implemented.

A solution that eliminates two out of the four dominant poles is shown in FIG. 7. The operation of the up and down mirror shown in FIG. 7 is exactly the same as for the up and down mirror shown in FIG. 3. The gain of the loops is reduced by $g^2_{mp} r^2_{op}$ while the transfer characteristic for any of the loops has two out of the four dominant poles eliminated. This is an important advantage for the frequency compensation process. There are however disadvantages, such as a reduction by $g^2_{mp} r^2_{op}$ in the output resistance for both up and down mirrors. Also, for the up mirror of FIG. 7, the fundamental condition for this circuit configuration as given by equation (1) is not fully obtained with high accuracy.

A solution for an efficient frequency compensation of the up and down current mirrors of FIG. 3 is provided next. The accuracy of the current mirrors and equation (1) are preserved. The disadvantage is the necessity of using larger transistors, as shown.

The four dominant poles are at $\omega=1/c_1 r_{op}$, so they depend on the output resistance of the PMOS transistors of the bias circuit and on the capacitance present at the drain of each respective PMOS transistor. The solution shifts one of the four dominant poles by increasing the output resistance of one of the four PMOS transistors of the bias circuit, and, if necessary, increasing the parallel capacitance $c_1$ by including a frequency compensation capacitor. Accordingly, the new transfer characteristic of the loop has one dominant pole while the other three poles of the original transfer function become insignificant. To accurately satisfy equation (1), the pole that is shifted is the one corresponding to the drain of M21. The shifting is realized by biasing the M13–M17–M21 branch of the bias circuit differently than the other three branches. If any of the other three poles are shifted according to this method, the closer the shifted pole is to the mirror transistor, the less precision for equation (1) is obtained. The sizing requirements to obtain an efficient frequency compensation according to this method are shown in FIG. 8. Knowing that $$R_o \approx \frac{V_A}{I_{DS}}, \tag{7}$$

and that $c_1$ is predominantly given by $C_{gs}$ which is proportional to the transistor width W, to shift one of the four poles from $\omega \approx 1/c_1 r_{op}$ so that the transfer function of the loop has one dominant pole, $r_{op}$ (the output resistance $R_o$) and $c_1$ must be both increased, becoming $r_{op1}$ and $C_{11}$. The new dominant pole will be at $\omega \approx 1/c_{11} r_{op1}$, while the other three poles remain at $\omega \sim 1/c_1 r_{op}$. The frequency shift of the new dominant pole is directly proportional to the gain of the loop.

Referring to FIG. 8, the new dominant pole is introduced for M21. To increase the output resistance of M21 as compared to the output resistance of M18, M19 and M20, I1 must be much smaller than I2, I3, and I4, which are approximately equal to one another. This is realized by making M13 much smaller than M12, M11, M10, M3, and M4. Accordingly, M3=M4=M10=M11=M12=L (large). M13=SE (small) and also preferably M13=M17=M21=SE (small and equal). The increased $c_1$ is realized by the frequency compensation capacitor C. This capacitor may not be necessary, depending on the bias conditions, loop gain, and on the capacitive load present at the drain of M21. The other three poles corresponding to the drains of M20, M19, and M18 must be much larger as compared to the new dominant pole introduced at the drain of M21 so that the gain at approximately one octave lower than omega$\approx 1/c_1 r_{op}$ is maximum 1. Accordingly, a small $R_o$ and a small $c_1$ is required. The small $R_o$ is provided by the large I2, I3, and I4 as discussed, while a small $c_1$ is provided by the small size of M21, M20, M19, and M18. However, the sizes should not be too small sizes to avoid handling large currents, and disproportionate $V_{GS}$ voltages that degrades the accuracy as well as the output swing. As shown in FIG. 8, M18=M19=M20=OE (optionally equal to M21). Usually, due to the large I2, I3, and I4 as compared to I1, OE is larger than SE. Depending on biasing, O is preferably equal to L, where O=M14=M15=M16.

According to equation (2), a W size transistor biased by a current I would have the same $V_{GS}$ as a W/k transistor biased by an I/k current, as long as $V_{DS}$ in the two cases is similar, where k is an arbitrary coefficient. Even if practically this is not very accurate, a good precision for, equation (1) is obtained if the M21 and M20 branches are biased and sized according to an I/k—W/k rule. The precision may be affected, by another biasing combination.

The same frequency compensation can be applied for the current mirrors of FIG. 7, where one of the two dominant poles is shifted. Note that the required shift is much smaller than for the current mirrors of FIG. 3 due to the lower gain and smaller number of poles of the current mirrors of FIG. 7. The disadvantage, as mentioned, is a lower output resistance and also that equation (1) is not satisfied with high precision for the up mirror, affecting the up mirrored current. An up mirror configuration that solves these two problems while using a two-branches bias circuit is shown in FIG. 9. This configuration obtains a high precision for the up mirrored current, equation (1) being satisfied with high accuracy for both up and down mirrors. However, a higher dependency on load is noted due to the lower output resistance. This configuration (see FIG. 9) requires three identical bias circuits, two identical down mirrors, and a new up mirror cell where MU1=M26=M261. Note that there are no supplemental stability problems if the dominant pole introduced at the drain of M19 (M39 and M391) is correctly sized. Note an increased capacitive load at the drains of M19 and M39, due to the supplemental connected gates at these nodes. The configuration of FIG. 9 can use bias circuits with four branches, providing improved performance. Note that the configuration of FIG. 9 also provides improved tolerance to process parameter variations, since to obtain the up mirrored current, two identical branches are used, each branch being composed of a bias circuit and a down mirror. Any process parameter variations are typically equally present in each branch and cancel each other. The down mirror of FIG. 3 has also improved tolerance to process parameter variations, due to the same symmetry reason.

The down mirror can be terminated with a current divider (division by two as shown in FIG. 3). Using two identical paths, namely M25 to M26 and M27 to M28, an accurate division is obtained. The resulting half current $I_{DSM28}$ can be repeatedly divided using the same methodology. The resulting half current may also source an arbitrary load by being taken over by an up or down mirror according to FIG. 5. As described by equation (2), in order to use the same bias circuit to perform the next mirroring and/or division, M26 and M28 must be sized by W/2. Equation (2) then becomes $$\frac{I_{DS}}{2} = K\frac{W}{2L}(V_{GS} - V_T)^2(1 + \lambda V_{DS}), \tag{8}$$

with $V_{GS}=V_{DS}$, keeping $V_{GSM28}=V_{GSM1}$ ($V_{GSW28}=V_{DSM28}$). By subsequently dividing the current, a series of reference currents are obtained, appropriate for high precision A/D and D/A converters.

Figure 1:
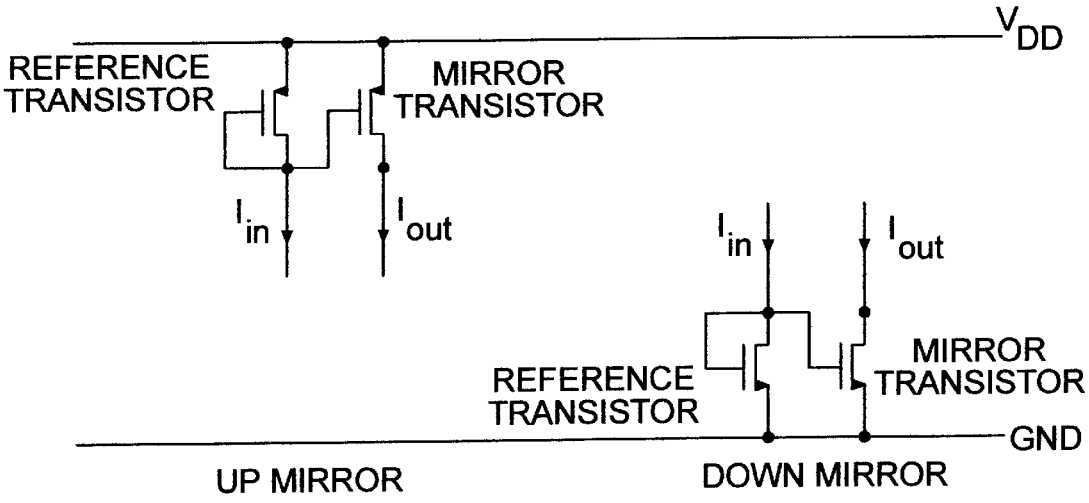
FIG. 1 (PRIOR ART)
FIG. 1 is a simplified, schematic diagram (schematic) of an up and down current mirror, according to the prior art.
Figure 2:
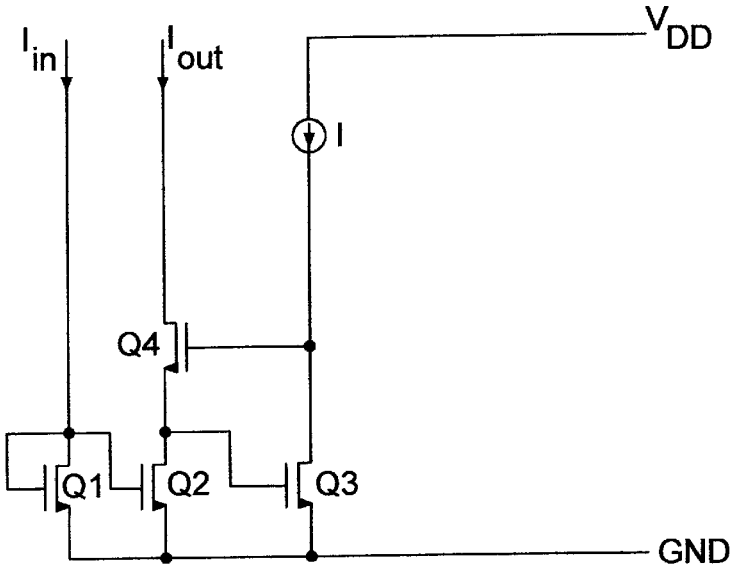
FIG. 2 (PRIOR ART)
FIG. 2 is a schematic of a current mirror employing active feedback, according to the prior art.

Preferably, the reference cell is designed according to the specific requirements of the application. Simple rules in sizing the transistors within the circuit are required. In the reference cell (see FIG. 2), $I_{DSM1}$ is the reference input current. The reference voltages are $V_{M3}$ and $V_{M5}$. Typically, $V_{M5}-2V_{M3}$ or higher. M2 is a buffer transistor, and all the power supply variations affect $V_{DSM2}$. Considering a constant $I_{DSM3}$, the $V_{DD}$ variations reflected on $V_{DSM2}$ result in a variable $I_{DSM1}$, which is the initial reference current for the circuit. If a relative value for $I_{DSM1}$ is appropriate for the application, then no modifications are necessary. If a constant $I_{DSM1}$ is needed, however, the current source for $I_{DSM3}$ design considers variations in $I_{DSM1}$ due to variations in $V_{DSM2}$. However, even in high precision converters, a constant $I_{DSM3}$ can be used if the voltage to current converter of the input signal provides the input current which varies with $V_{DD}$ over an equivalent $V_{DSM2}$. The mirroring accuracy remains constant with respect to $I_{DSM1}$ variations. $I_{DSM1}$ is mirrored with the same precision independent of its value.

Certain transistors are essentially alike as indicated by the equal (=) sign. Specifically, M1=M6=M18=M19=M20=M21=M22=M37=M38=M39=M40, M2=M14=M15=M16=M17=M29=M30=M31=M32, M23=M9, M3=M4=M10=M11=M12=M13=M33=M34=M35=M36, and M8=M7=M24. Alternative sizing as described for FIGS. 7, 8, and 9 are applicable. All transistors are biased to operate in saturation all the time. After a division, the reference current for the second current mirror divider is $I_{DS}/2$. M28 replaces M1 as the reference transistor, and the transistor sizes of this cell are referenced accordingly. The proper relative sizing depends on the specific performance and design requirements of the application. However, since as discussed, practically equations (2) and (8) do not hold for high precision applications, a W size transistor biased by a current I would not have exactly the same $V_{GS}$ as a W/2 transistor biased by an I/2 current (when the $V_{DS}$ in the two cases is similar). This creates an error (albeit small) in mirroring the I/2 current since $V_{GS}$ has small variations between the two cases. In the following mirror cell having M28 as the reference transistor, the cascode current sources in the bias circuit are slightly changing the load from the initial case, giving different currents and creating a disequilibrium with the reference branch of the mirror, for which the current is provided by a high accuracy down mirror, insensitive to load variations. This disequilibrium affects slightly the mirroring accuracy. The mirroring accuracy can be improved if the output resistance of the cascode current sources is increased for example by increasing the transistor sizes, this way improving their sensitivity to load variations. Different current source configurations with higher output resistance can be used instead of the cascode current sources, improving this problem. Circuitry to handle the divided currents and maintain the same high accuracy are described next.

Satisfactory mirroring precision, however, is obtained considering equations (2) and (8) as accurate. Better precision is obtained using the circuit in FIG. 10 for the bias circuits of the cell that handles the divided current. Instead of the M18–M21 group of transistors of size W, each transistor is replaced by a group of two transistors in parallel, each sized W/2, with each group of two transistors sinking the same current as the initial single transistor while providing the proper bias. This halving of transistors which are used, as in a long chain of divisions (such as converters) may lead to small transistors and greater sensitivity to imperfections.

The circuit shown in FIG. 11, implements a division method which, maintains the same transistor sizes. Here, the two paths consist of M1 and M0 of size W, rather than M25 and M27, as shown in FIG. 3. In FIG. 11, besides M1 and M0, all the transistors in the bias circuit are of size W. However, the mirroring precision may be affected more than in FIG. 3, since the load of the cascode current sources in the bias circuit is affected more than in the previous case. The reference voltage on M28 in both cases uses a high accuracy current provided by a down mirror, while the cascode current sources are more sensitive to the load.

Every up mirror, down mirror, or division may have a bias circuit which operates with a high initial reference current ($I_{DSM1}$), no matter what current is mirrored or divided. This increases dissipated power. A bias circuit operating at small currents with small transistors may require a constant correction factor applied to the mirrored current, the advantage being smaller area and power, the disadvantage being a smaller precision and extra hardware. In the case of a converter, these corrections can be implemented by a digital post processing of the converted sample, saving power and area.

Several circuits which obtain a series of high accuracy reference currents, a current summator, a current subtractor, and a current comparator, all based on the herein disclosed current mirror topology, are presented next. For convenience, the transistor numbers refer to the up and down mirrors of FIG. 3. However, any of the current mirror configurations can be used (see FIGS. 7, 8, and 9) by considering the sizing issues discussed above.

A simpler less accurate circuits (following a first design method) to obtain the series of currents, is summarized in Table I. The up mirror is discussed, for the down mirror the methodology is similar. I is the initial reference current. Instead of using aspect ratio variations for different transistors to obtain the series of divided currents, the method uses multiple parallel transistors of the same size W, improving the mirroring accuracy. In Table I, the transistor sizes refer to the number of parallel transistors of size W. Approximately the same biasing characteristics for the transistors are maintained while varying the number of parallel transistors to provide the different currents. Note that thirteen reference currents are obtained, with three different mirroring precisions due to the effects mentioned above. There are five currents obtained with the highest precision, P11. The precision for the next four currents, P12, decreases. The principal cause of the decrease is due to the nonequilibrium between the reference branch and the bias circuit. To minimize this nonequilibrium, W/16 transistor sizes are used (see Table I), assuming that an I/16 current through a W/16 transistor is similar to an I current through a W transistor. $V_{ref1}$ is provided by a down current mirror to provide an accurate reference current used for the next divisions. Note that the initial W must be at least 16 times the minimal transistor, since W/16 transistors are required. The last four currents provide the P13 precision. The major accuracy decrease for these four currents is due to the significant, unavoidable load variations of the cascode current sources from the bias circuit. The load transistors remain constant (a W/256 value would be necessary to maintain an approximately constant current).

The second methodology for obtaining a series of high precision reference currents is presented next. The method eliminates the error due to the disequilibrium between the bias circuit and the reference branch as discussed in the first method. Briefly, the method is characterized by the following:

1. To eliminate the mirroring inaccuracies given by the cascode current sources from the bias circuit that creates the nonequilibrium with the reference branch, down mirrors are used for each of the four cascodes.

2. By using down mirrors, the load can be varied according to the need. The only condition is the load is the same for all the four current sources of the bias circuit and for the reference voltage $V_{ref}$.

3. Minimal transistors can be used, saving area. In the previous method, transistors of size equal to 16 times the minimal size were necessary. No parallel groups of multiple transistors are required, as in the previous method.

4. A block schematic is shown in FIG. 12, and used in the following discussion.

5. Table 12 shows the transistor sizing and the mirroring accuracy for the divided currents. Block1 in FIG. 12 is used for the first five currents. Alternatively, for the first five currents the simple cascode biasing can be used, since the load of the cascode current sources is not changing. For the next four currents, the load is changing for the reference as well for the cascode current sources. To eliminate the consequences, Block2 is used to mitigate this load dependency. Finally, for the last four currents, Block3 is used. Note that the current sources have $I=I_{ref}/16$ in Block3.

6. The accuracy for this methodology remains high for all the currents. The complexity increase due to the use of a down current for each cascode current source from the bias circuits is compensated by the fact that only minimum transistors are needed and no parallel groups of similar transistors are required. A better accuracy is obtained with less area than for the first method.

Figure 13B:
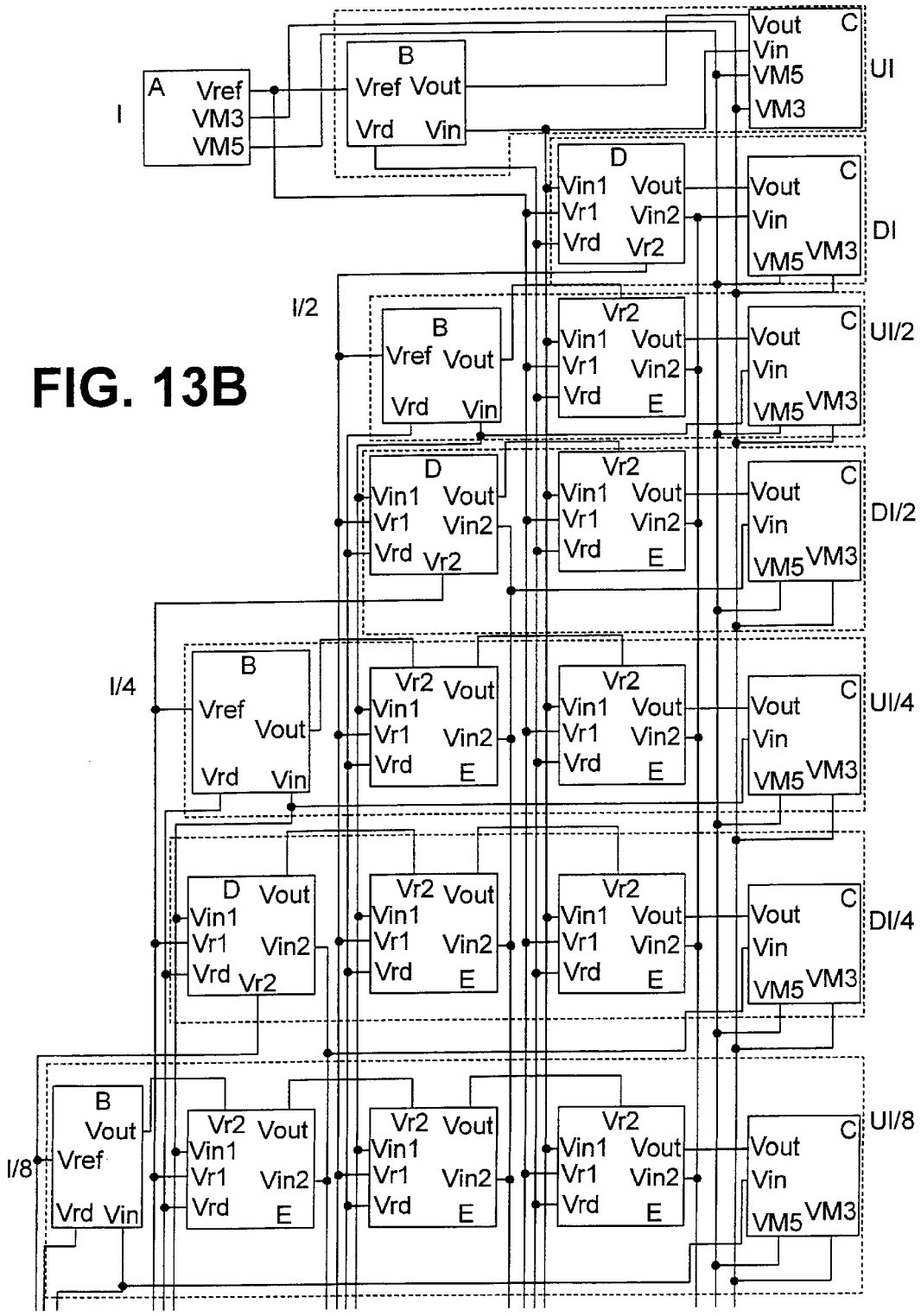

The third method for obtaining a series of high precision reference currents uses the up current mirror shown in FIG. 9. The bias circuits may have two or four branches. For simplicity, the circuit schematics are shown for bias circuits having two branches. A block schematic to exemplify the third method is shown in FIG. 13. This schematic divides the currents coming from down mirrors. A similar configuration can be realized when the currents coming from the up mirrors are divided. The advantage of this configuration is

TABLE I

TRANSISTOR SIZING AND PRECISION FOR THE FIRST METHOD OF OBTAINING A SERIES OF HIGH PRECISION REFERENCE CURRENTS.

| Mirrored current value | Transistor sizes (in W) | Relative precision |
|---|---|---|
| 16I | M1 = M18 . . . M21 = 1, M2 = M14 = . . . M17 = M4 = M10 = . . . M13 = 16, M6 = 16 | P11 |
| 8I | M1 = M18 . . . M21 = 1, M2 = M14 = . . . M17 = M4 = M10 = . . . M13 = 16, M6 = 8 | P11 |
| 4I | M1 = M18 . . . M21 = 1, M2 = M14 = . . . M17 = M4 = M10 = . . . M13 = 16, M6 = 4 | P11 |
| 2I | M1 = M18 . . . M21 = 1, M2 = M14 = . . . M17 = M4 = M10 = . . . M13 = 16, M6 = 2 | P11 |
| I | M1 = M18 . . . M21 = 1, M2 = M14 = . . . M17 = M4 = M10 = . . . M13 = 16, M6 = 1 | P11 |
| I/2 | M1 = M18 = . . . M21 = 16XW/16, M2 = M14 = . . . M17 = M4 = M10 = . . . M13 = 16, M6 = 8 | P12 |
| I/4 | M1 = M18 = . . . M21 = 16XW/16, M2 = M14 = . . . M17 = M4 = M10 = . . . M13 = 16, M6 = 4 | P12 |
| I/8 | M1 = M18 = . . . M21 = 16XW/16, M2 = M14 = . . . M17 = M4 = M10 = . . . M13 = 16, M6 = 2 | P12 |
| I/16 | M1 = M18 = . . . M21 = 16XW/16, M2 = M14 = . . . M17 = M4 = M10 = . . . M13 = 16, M6 = 1 | P12 |
| I/32 | M1 = M18 = . . . M21 = 16XW/16, M2 = M14 = . . . M17 = M4 = M10 = . . . M13 = 16, M6 = 8 | P13 |
| I/64 | M1 = M18 = . . . M21 = 16XW/16, M2 = M14 = . . . M17 = M4 = M10 = . . . M13 = 16, M6 = 4 | P13 |
| I/128 | M1 = M18 = . . . M21 = 16XW/16, M2 = M14 = . . . M17 = M4 = M10 = . . . M13 = 16, M6 = 2 | P13 |
| I/256 | M1 = M18 = . . . M21 = 16XW/16, M2 = M14 = . . . M17 = M4 = M10 = . . . M13 = 16, M6 = 1 | P13 |

Note that this method obtains 13 high precision currents with three distinct levels of mirroring accuracies. W is at least 16 times the minimal size, and the smallest size is W/16. Multiple groups of transistors are used in several points of the schematic instead of multiple aspect ratios, to provide higher precision.

that unlimited current divisions can be realized with identical blocks A, B, C, D, and E as shown in FIG. 13, all the blocks having the same size for the transistors. Accordingly, the precision is kept constant for any number of divisions. Special care to frequency compensation is required. A disadvantage is that a current mirror to handle a divided current with high precision may become very complex, the complexity increasing as the current is smaller. For example, in FIG. 13, a current mirror that handles the up I/8 current is UI/8.

TABLE II

TRANSISTOR SIZING AND PRECISION FOR THE SECOND METHOD OF OBTAINING A SERIES OF HIGH PRECISION REFERENCE CURRENTS.

| Mirrored current value | Transistor sizes (in W) | Relative precision |
|---|---|---|
| 16I | M1 = M18 = . . . M21 = 1, $I_{bias}$ = I, M6 = 16 | P21 |
| 8I | M1 = M18 = . . . M21 = 1, $I_{bias}$ = I, M6 = 8 | P21 |
| 4I | M1 = M18 = . . . M21 = 1, $I_{bias}$ = I, M6 = 4 | P21 |
| 2I | M1 = M18 = . . . M21 = 1, $I_{bias}$ = I, M6 = 2 | P21 |
| I | M1 = M18 = . . . M21 = 1, $I_{bias}$ = I, M6 = 1 | P21 |
| I/2 | M1 = M18 = . . . M21 = 16, $I_{bias}$ = I, M6 = 8 | P22 |
| I/4 | M1 = M18 = . . . M21 = 16, $I_{bias}$ = I, M6 = 4 | P22 |
| I/8 | M1 = M18 = . . . M21 = 16, $I_{bias}$ = I, M6 = 2 | P22 |
| I/16 | M1 = M18 = . . . M21 = 16, $I_{bias}$ = I, M6 = 1 | P22 |
| I/32 | M1 = M18 = . . . M21 = 1, $I_{bias}$ = I/16, M6 = 8 | P23 |
| I/64 | M1 = M18 = . . . M21 = 1, $I_{bias}$ = I/16, M6 = 4 | P23 |
| I/128 | M1 = M18 = . . . M21 = 1, $I_{bias}$ = I/16, M6 = 2 | P23 |
| I/256 | M1 = M18 = . . . M21 = 1, $I_{bias}$ = I/16, M6 = 1 | P23 |

The three discussed methods of obtaining a series of high precision currents can be combined for optimum performance. For example, the first five currents can be obtained according to the first method with a high precision, the next four currents can be obtained according to the second method by using down current mirrors instead of the cascode current sources of the bias circuit, and the last four currents can be obtained according to the third method, obtaining a high precision for all the currents.

An up or down high precision current summator can be easily realized once a series of high reference currents are obtained according to one of the above two methods. The up high precision current summator is simply obtained by connecting on the same load the sources of the M9 transistors of different up current mirrors. Similarly, the down high precision current summator is obtained by connecting on the same load the drains of the M25 transistors of different down current mirrors.

A block schematic of a current comparator containing a two currents summator is shown in FIG. 14. This high precision current comparator with A/D conversion is based on the up and down mirrors hereof and can be used in A/D or D/A converters. The high precision current comparator having an A/D output is realized using up and down current mirrors. If an up and a down current mirrors are considered, the comparison node is the node where the source of M9 (the output of the up mirror) and the drain of M25 (the output of the down mirror) meet. If the current to be compared is an up current, $I_{comp}$, then it is coming from an up mirror, namely from an M9 source. Down current mirrors are used to generate a series of reference currents. The reference currents are summed using a current summator as shown above, and a resulting current $I_{sum}$ is obtained. Switches are inserted between the drain of M25 transistors and the summation point. The comparison can be monitored at the bias circuit nodes, for example at the drain of M20, or at the drain of M38. Consider for simplicity that $I_{sum}$ consists only of a reference current, coming from only one down mirror. If $I_{sum}$ is less than $I_{comp}$, then the $I_{comp}$ mirror is forced to accept $I_{sum}$ as its current. $V_{DSM6}$ decreases, and the bias circuit controlling the up mirror loses its equilibrium. Since the drain of M20 is the node under observation for the A/D conversion, the drain of M20 drops towards ground due to the loss of equilibrium, and it is the flag for the digital processing that $I_{sum}$ is less than $I_{comp}$. Similarly if $I_{sum}$ is greater than $I_{comp}$, the drain of M38 drops to ground in the $I_{sum}$ mirror. If $I_{sum}$ consists of a summation of currents, then if $I_{sum}$ is less than $I_{comp}$, the situation is similar to the above and the drain of M20 drops to ground. If $I_{sum}$ is greater than $I_{comp}$, then $I_{comp}$ is distributed between all the down mirrors of $I_{sum}$, and all the down mirrors are disequilibrated, and all the M38 drains drop to ground. As the equality $I_{sum}$=$I_{comp}$ is approaching, the less significant currents of $I_{sum}$ equilibrates, and their M38 drains signals this. The most significant currents of $I_{sum}$ remain disequilibrated, and their M38 drains remain to ground. Finally, in the vicinity of the equality when $I_{sum}$ becomes slightly smaller than $I_{comp}$, all M38 drains become equilibrated and M20 of $I_{comp}$ drops to ground. The current switches select the down currents for the A/D conversion process.

The CMOS current mirror/divider circuit topology of this invention can provide high accuracy mirrored current and offers an added capability for switching the up and down current (the ping-pong facility), especially applicable to certain high precision analog and mixed signal circuits. The current mirror circuit offers a high design precision in up and down mirroring and in division, together with excellent behavior over supply voltage variations, input current variations, temperature variations, and load variations. To obtain the predicted accuracy, transistor matching is required, and the used process must be characterized by good lithography precision and local $V_T$ variations. The larger the transistor sizes, the better the matching, minimizing the sensitivity to process variations and increasing circuit accuracy. Another advantage of the proposed circuit is that the transistor matching can be made in standard, well defined sizes. Using the current mirror together with the ping-pong facility, several high precision applications can be realized, such as obtaining a series of high precision reference currents to be used in A/D and D/A converters, an up or down current summator, and a current comparator with direct A/D conversion. The proposed high precision reference currents are obtained without the typical aspect ratio problems even for high precision converters. In summary, this current mirror topology provides an important enhancement in performance and capability for application to higher precision, lower cost current mode applications.

An up or down high precision current substractor can be realized as shown in FIG. 15, where an up current substractor is discussed. Consider $I_x$ as the input, unknown current, supplied by an up current mirror, namely the $I_x$ up mirror in FIG. 15. Consider a down current mirror the $I_d$ down mirror in FIG. 15, generating the $I_d$ reference current. Using a high precision current comparator according to the invention, it is determined that $I_x$ is greater than $I_d$. The difference between $I_x$ and $I_d$ can be generated with high accuracy according to FIG. 15, where the output current of the current substractor, $I_r$, is equal to $I_x$ minus $I_d$. Similarly, a high precision down current substractor can be obtained.

Variation and modifications in the herein described circuits, within the scope of the invention, will undoubtedly suggest themselves to those skilled in the Art. Accordingly, the foregoing description should be taken as illustrative and not in a limiting sense.

What is claimed is:

1. A current mirror circuit comprising two reference transistors (first and second), three mirror transistors (first, second, and third), three buffer transistors (first, second, and third,) two amplifier circuits (first and second), and two power supply lines (high voltage and low voltage), wherein:

(a.) said reference transistors are transistors that have the drain thereof connected to gate thereof and that has the source thereof connected to one of the said two power supply lines, (b.) said mirror transistors are transistors that has the gate thereof connected to the drain of one said reference transistors, and that has the source thereof connected to the same power supply line as the source of the reference transistor to which the gate of said mirror transistor is connected to, (c.) said buffer transistors are transistors that have either the source or the drain thereof connected to the drain of one of said mirror transistors and to the gate of another transistor which provides an input of an amplifier which has the output thereof connected to the gate of said buffer transistor, and where the said amplifier is either of said first or second amplifiers, (d.) the gates of said first and second mirror transistors are connected to the gate of said first reference transistor, (e.) a load of said first buffer transistor is said second reference transistor, (f.) a load of said second buffer transistor is the drain of a load transistor that has the source thereof connected to the same power supply line as said second reference transistor, (g.) said first amplifier is connected between the drain of said first mirror transistor and the gate of said first buffer transistor, (h.) the gate of said third mirror transistor is connected to the gate of said second reference transistor, (i.) the gate of said load transistor is connected to the drain of said third mirror transistor and to either the drain or the source of said third buffer transistor, (j.) the gate of said second buffer transistor is connected to the gate of said first buffer transistor, and (k.) said second amplifier is connected between the drain of said second mirror transistor and the gate of said third buffer transistor, (l.) whereby when said first reference transistor receives a constant input current $I_{in,}$ said third buffer transistor generates a constant output current $I_{out}$ on a variable load.

2. The current mirror circuit of claim 1 wherein:

(a.) said first and second amplifiers provide a plurality of branches where each branch includes a PMOS transistor that has the source thereof connected to said high voltage power supply line, that has the gate thereof connected to the drain of one of said mirror transistors when said PMOS transistor is included in a first of said plurality of branches of said first or second amplifiers, (b.) said one of said mirror transistor has the gate thereof connected to the drain of said PMOS transistor of said first branch, and said one mirror transistor has the drain thereof connected to a current source, and (c.) the output of said first or second amplifier is the drain of said PMOS transistor which is included therein.

3. The circuit of claim 2 further comprising means to obtain any desired current division or any desired series of reference currents.

4. The current of claim 2 and at least an identical circuit thereto providing a plurality of circuits of claim 2 wherein the output currents $I_{out}$ of each of said sixth buffer transistors of each of said claim 2 circuits are connected together creating a current summator, and wherein said summator provides a total current which is the sum of each output current of each of said circuits.

5. The circuits of claim 4 herein means are provided for comparing the said sum current to another sum current of opposite sense to the said sum current, wherein the said another sum current is generated by the second plurality of current mirror circuits wherein each current mirror circuit of said second plurality of current mirror circuits has at least one reference transistor, one mirror transistor, one buffer transistor, and one (first) amplifier circuit with at least two branches, wherein said two branches are like the branches of the first plurality of current mirror circuits, and wherein the current comparison result is obtained from notes of said first amplifier circuits corresponding to each of the said current mirror circuits of both said first and second pluralities of current mirror circuits, from nodes of said second amplifier circuits of said first plurality of current mirror circuits, and from nodes of other amplifier circuits of said second plurality of current mirror circuits.

6. A current subtracter circuit comprising a first current mirror circuit according to claim 2 which generates a constant output current $_{Iout}$ on a variable load at the output of the said third buffer transistor, the said current subtracter circuit comprising in addition another current mirror circuit which, (a.) generates a current $I_x$ of opposite sense than said current $I_{out}$ and smaller in magnitude than said current $I_{out}$, (b.) has the output connected to the drain of said third mirror transistor of said first current mirror circuit, (c.) so that said third buffer transistor generates a constant current on a variable load at the output of said first current mirror circuit which is the difference in magnitude between said current $_{Iout}$ and said current $I_x$.

7. The circuit of claim 1 further comprising means to obtain any desired current division or any desired series of reference currents.

8. The circuit of claim 1 and at least another circuit of said claim 1 circuit, providing a plurality of circuit of said claim 1, wherein the output currents $I_{out}$ of each of said third buffer transistors of each of said plurality of claim 1 circuits are connected together creating a current summator, and wherein said summator provides a total current which is the sum of each of the constituent individual output currents of each of said plurality of circuits of claim 1.

9. A current subtracter circuit comprising a first current mirror circuit according to claim 1 which generates a constant output current $I_{out}$ on a variable load at the output of said third buffer transistor, the said current subtracter circuit comprising in addition another current mirror circuit which, (a.) generates a current $I_x$ of opposite sense than said current $_{Iout}$ and smaller in magnitude than said current $I_{out}$, (b.) has the output connected to the drain of said third mirror transistor of said first current mirror circuit, (c.) so that said third buffer transistor generates a constant current on a variable load at the output of said first current mirror circuit which is the difference in magnitude between said current $I_{out}$ and said current $I_x$.

10. A current mirror circuit comprising three reference transistors (first, second, and third), six mirror transistors (first, second, third, fourth, fifth, and sixth), six buffer transistors (first, second, third, fourth, fifth, and sixth), three amplifier circuits (first, second, and third), and two power supply lines (high voltage and low voltage), wherein:

(a.) said reference transistors are transistors that has the drain thereof connected to the gate thereof and that has the source thereof connected to one of the said two power supply lines, (b.) said mirror transistor are transistors that has the gate thereof connected to the drain of one said reference transistors and that has the source of said mirror transistor connected to the same power supply line as the source of the reference transistor to which the gate of said mirror transistor is connected to, (c.) said buffer transistors are transistors that have either the source or the drain thereof connected to the drain of one of said mirror transistors and to the gate of another transistor which provides an input of an amplifier which has an output thereof connected to the gate of said buffer transistor, and where said amplifier is any of said first, second, or third amplifiers, (d.) the gates of said first, second, and third mirror transistors are connected to the gate of said first reference transistor, (e.) a load of said first buffer transistor is said second reference transistor, (f.) a load of said second buffer transistor is the drain of a first load transistor that has the source thereof connected to the same power supply line as said second reference transistor, (g.) a load of said third buffer transistor is the drain of a second load transistor that has the source thereof connected to the same power supply line as said second reference transistor, (h.) said first amplifier circuit is connected between the drain of said first mirror transistor and gate of said first buffer transistor, (i.) the gates of said fourth and fifth mirror transistors are connected to the gate of said second reference transistor, (j.) the gate of said first load transistor is connected to the drain of said fourth mirror transistor and to one terminal of said fourth buffer transistor, (k.) the gate of said second load transistor is connected to the drain of said fifth mirror transistor and to said fifth buffer transistor, (l.) the gates of said second and third buffer transistors are connected to the gate of said first buffer transistor, (m.) said second amplifier circuit is connected between the drain of said second mirror transistor and the gates of said fourth and fifth buffer transistors, (n.) a load of said fourth buffer transistor is said third reference transistor, (o.) a load of said fifth buffer transistor is the drain of a third load transistor that has the source connected to the same power supply line as the said third reference transistor, (p.) the gate of said sixth mirror transistor is connected to the gate of said third reference transistor, (q.) the gate of said third load transistor is connected to the drain of said sixth mirror transistor and to said sixth buffer transistor, and (r.) said third amplifier is connected between the drain of said third mirror transistor and the gate of said sixth buffer transistor, (s.) whereby when said first reference transistor receives a constant input current $I_{in}$ said sixth buffer transistor generates a constant output current $I_{out}$ on a variable load.

11. The circuit of claim 10 further comprising means to obtain any desired current division or any desired series of reference currents.

12. The circuit of claim 10 and at least on identical circuit thereto providing transistors of each of said circuits are connected together creating a current summator, and wherein the total current is a sum of each of the constituent individual output currents of each of said circuits.

13. A current subtracter circuit comprising a first current mirror circuit according to claim 10 which generates a constant output current $I_{out}$ on a variable load at the output of said sixth buffer transistor, said current subtracter circuit comprising in addition another current mirror circuit which, (a.) generates a current $I_x$ of opposite sense than said current $I_{out}$ and smaller in magnitude than said current $I_{out}$, (b.) has the output connected to the drain of said sixth mirror transistor of said first current mirror circuit, (c.) so that said sixth buffer transistor generates a constant current on a variable load at the output of said first current mirror circuit which is the difference in magnitude between said current $I_{out}$ and said current $I_x$.

14. The current mirror circuit of claim 10 herein:

(a.) said first, second, and third amplifiers have a plurality of branches, where each branch includes PMOS transistor that has the source thereof connected to said high voltage power supply line and has the gate thereof connected to the drain of one of said mirror transistor and said one mirror transistor has the drain thereof connected to the output of a current source, and (b.) the outputs of said first, second, or third amplifier is the drain of the PMOS transistor of one of the branches thereof.

15. The circuit of claim 14 further comprising means to obtain any desired current division or any desired series of reference currents.

16. A current subtracter circuit comprising a first current mirror circuit according to claim 14 which generates a constant output current $I_{out}$ on a variable load at the output of said sixth buffer transistor, the said current subtracter circuit comprising in addition another current mirror circuit which, (a.) generates a current $I_x$ of opposite sense than said current $I_{out}$ and smaller in magnitude than said current $I_{out}$, (b.) has the output connected to the drain of said sixth mirror transistor of said first current mirror circuit, (c.) so that said sixth buffer transistor generates a constant current on a variable load at the output of said first current mirror circuit which is the difference in magnitude between said current $I_{out}$ and said current $I_x$.

17. The circuit of claim 14 and at least an identical circuit thereto providing a plurality of circuits of claim 14 wherein the output currents $I_{out}$ of each of said sixth buffer transistors of each of said plurality of circuits are connected together creating a current summator, which provides a total current which is the sum output currents of each of said plurality of circuits.

18. The circuits of claim 17 and wherein means are provided for comparing said sum current to another sum current of opposite sense to the said sum current, wherein the said another sum current is generated by a second plurality of current mirror circuits wherein each current mirror circuit of said second plurality of current mirror circuits has at least one reference transistor, one mirror transistor, one buffer transistor, and one (first) amplifier circuit with at least two branches, wherein the said at least two branches are like the branches of the first plurality of current mirror circuits, and wherein the current comparison result is obtained from nodes of said first amplifier circuits corresponding to each of said current mirror circuits of both said first and second pluralities of current mirror circuits, from nodes of said second and third amplifier circuits of said first plurality of current mirror circuits and from nodes of any other amplifier circuits of said second plurality of current mirror circuits.

19. A system comprising a first plurality of current mirror circuits, each of the said current mirror circuits having one (first) reference transistor, one (first) mirror transistor, one (first) buffer transistor, an amplifier circuit, and two power supply lines (high voltage and low voltage) wherein:

(a.) said reference transistor is a transistor that has the drain thereof connected to the gate thereof and that has the source thereof connected to one of the said two power supply lines, (b.) said mirror transistor is a transistor that has the gate thereof connected to the drain of said reference transistor, and that has the source of said mirror transistor connected to the same power supply line as the source of the reference transistor to which the gate of the mirror transistor is connected to, (c.) said buffer transistor is a transistor that has either the source or the drain thereof connected to the drain of the mirror transistor and to the gate of another transistor which is the input of an amplifier which has an output connected to the gate of said buffer transistor, and where said amplifier is said first amplifier circuit, (d.) said first amplifier circuit has at least two (first and second) branches wherein each of said branches includes a PMOS transistor that has the source thereof connected to said high voltage power supply line, that has the gate thereof connected to the drain of said mirror transistor when said PMOS transistor is in the first branch of said first amplifier, or the gate of said mirror transistor is connected to the drain of the PMOS transistor of the first branch when said PMOS transistor is in the second branch of said first amplifier, and said PMOS transistor has the drain thereof connected to a current source, and wherein, (e.) the output of said first amplifier is the drain of the PMOS transistor in one of the branches of said first amplifier, so that when said first reference transistor receives a constant input current $I_{in}$, said first buffer transistor generates a constant output current $I_{out}$ on a variable load, and wherein, (f.) said output currents $I_{out}$ of each of said first buffer transistors of each current mirror of said first plurality of current mirrors have the same sense and are connected together creating a current summator wherein the resulting current is a sum current of each of said individual $I_{out}$ output currents of each said current mirrors of said first plurality of current mirror circuits, and wherein, (g.) means are provided for comparing the said sum current to another sum current of opposite sense to the said sum current, wherein said another sum current is generated by a second plurality of current mirror circuits wherein each current mirror circuit of said second plurality of current mirror circuits has at least one reference transistor, one mirror transistor, one buffer transistor, and one (first) amplifier circuit with at least two branches where the said at least two branches are like the branches of the current mirrors of the first plurality of current mirror circuits, and wherein, (h.) the current comparison result is obtained from nodes of said first amplifier circuits corresponding to each of said current mirror circuits of both said first and second pluralities of current mirror circuits.

20. A current subtracter circuit comprising a first current mirror circuit having one (first) reference transistor, one (first) mirror transistor, one (first) buffer transistor, an amplifier circuit, and two power supply lines (high voltage and low voltage) wherein:

(a.) a reference transistor is a transistor that has the drain thereof connected to the gate thereof and that has the source thereof connected to one of said two power supply lines, (b.) a mirror transistor is a transistor that has the gate thereof connected to the drain of said reference transistor and that has the source of said mirror transistor connected to the same power supply line as the source of the reference transistor to which the gate of said mirror transistor is connected to, (c.) a buffer transistor is a transistor that has either the source or the drain thereof connected to the drain of the mirror transistor and to the gate of another transistor which provides the input of said amplifier which has the output thereof connected to the gate of said buffer transistor, (d.) said amplifier circuit has a plurality of branches wherein each branch includes a PMOS transistor that has the source thereof connected to said high voltage power supply line, that has the gate thereof connected to the drain of said mirror transistor when said PMOS transistor is in the first branch of said amplifier, or the gate of said mirror transistor is connected to the drain of the PMOS transistor of the first branch when said PMOS transistor is in the second branch of said amplifier, and said PMOS transistor has the drain thereof connected to the output of a current source, and wherein, (e.) the output of said first amplifier is the drain of the PMOS transistor of one of the branches of said amplifier so that when said first reference transistor receives a constant input current $I_{in}$, said first buffer transistor generates a constant output current $I_{out}$ on a variable load, said current subtracter circuit comprising in addition another current mirror circuit which, (f.) generates a current $I_x$ of opposite sense than said current $I_{out}$ and smaller in magnitude than said current $I_{out}$, (g.) has the output connected to the drain of the said first mirror transistor, so that said first buffer transistor generates a constant current on a variable load at the output of said first current mirror circuit which is the difference in magnitude between said current $i_{out}$ and said current $I_x$.

* * * * *